US008165514B2

(12) United States Patent
Katano et al.

(10) Patent No.: US 8,165,514 B2
(45) Date of Patent: Apr. 24, 2012

(54) FIXING DEVICE, AND IMAGE FORMING METHOD AND IMAGE FORMING APPARATUS USING THE SAME

(75) Inventors: Yasuo Katano, Yokohama (JP); Tsuneo Kurotori, Tokyo (JP); Tomoyasu Hirasawa, Yokohama (JP); Tomoaki Sugawara, Atsugi (JP); Takuma Nakamura, Yokohama (JP); Yuko Arizumi, Yokohama (JP)

(73) Assignee: Ricoh Company, Limited, Tokyo (JP)

( * ) Notice: Subject to any disclaimer, the term of this patent is extended or adjusted under 35 U.S.C. 154(b) by 938 days.

(21) Appl. No.: 12/163,014

(22) Filed: Jun. 27, 2008

(65) Prior Publication Data

US 2009/0003903 A1 Jan. 1, 2009

(30) Foreign Application Priority Data

Jun. 29, 2007 (JP) ..... 2007-171480

(51) Int. Cl.
*G03G 15/20* (2006.01)

(52) U.S. Cl. ..... 399/340; 430/124.21; 430/124.22

(58) Field of Classification Search ..... 399/340; 430/124.21–124.22
See application file for complete search history.

(56) References Cited

U.S. PATENT DOCUMENTS

| | | | | |
|---|---|---|---|---|
| 7,734,237 | B2 * | 6/2010 | Mukai | 399/307 |
| 7,773,932 | B2 * | 8/2010 | Katano et al. | 399/340 |
| 7,869,754 | B2 * | 1/2011 | Katano et al. | 399/340 |
| 8,019,267 | B2 * | 9/2011 | Katano et al. | 399/340 |
| 2007/0098469 | A1 * | 5/2007 | Yoshino et al. | 399/340 |
| 2007/0264058 | A1 * | 11/2007 | Mukai | 399/307 |
| 2008/0063446 | A1 * | 3/2008 | Katano et al. | 399/340 |
| 2009/0151625 | A1 * | 6/2009 | Matsumoto et al. | 118/100 |
| 2011/0002718 | A1 * | 1/2011 | Katano et al. | 399/340 |
| 2011/0013957 | A1 * | 1/2011 | Katano et al. | 399/340 |
| 2011/0151370 | A1 * | 6/2011 | Shitara et al. | 430/109.4 |
| 2011/0177450 | A1 * | 7/2011 | Uekawa et al. | 430/124.22 |
| 2011/0229231 | A1 * | 9/2011 | Kaneko et al. | 399/340 |

FOREIGN PATENT DOCUMENTS

| | | | |
|---|---|---|---|
| JP | 59-119364 | | 7/1984 |
| JP | 3290513 | | 3/2002 |
| JP | 2004-109747 | | 4/2004 |
| JP | 2004-109749 | | 4/2004 |
| JP | 2008107517 | A * | 5/2008 |
| JP | 2011128449 | A * | 6/2011 |
| JP | 2011128452 | A * | 6/2011 |
| JP | 2011128457 | A * | 6/2011 |

OTHER PUBLICATIONS

English machine translation of Japanese document, Katano et al. (JP 2008107517 A).*

* cited by examiner

*Primary Examiner* — David Gray
*Assistant Examiner* — Geoffrey Evans
(74) *Attorney, Agent, or Firm* — Oblon, Spivak, McClelland, Maier & Neustadt, L.L.P.

(57) ABSTRACT

A fixing device, and an image forming method and an image forming apparatus using the fixing device. The fixing device includes an application unit to apply a foam-like fixing agent including a softener to particulates including a resin on a medium, the softener softening the particulates by at least partially dissolving or swelling the resin and a thickness control unit to control a layer thickness of the foam-like fixing agent such that an application time during which the foam-like fixing agent is applied to the particulates is not shorter than a penetration time required for the foam-like fixing agent to penetrate through a layer of the particulates to the medium.

8 Claims, 12 Drawing Sheets

FIXING DEVICE, AND IMAGE FORMING METHOD AND IMAGE FORMING APPARATUS USING THE SAME

CROSS-REFERENCE TO RELATED APPLICATION

This patent specification is based on and claims priority from Japanese Patent Application No. 2007-171480, filed on Jun. 29, 2007 in the Japan Patent Office, the entire contents of which are hereby incorporated by reference herein.

BACKGROUND

1. Field of the Invention

The present invention relates to a fixing device, and an image forming method and an image forming apparatus using the fixing device.

2. Description of the Related Art

An image forming apparatus, such as a printer, a facsimile, or a copier, forms an image including a character or a symbol on a recording medium, such as paper, cloth, or an OHP (overhead projector) sheet, based on image information. An electrophotographic image forming apparatus capable of forming a high-resolution image on a plain paper sheet at high speed is particularly widely used in offices. Such an electrophotographic image forming apparatus typically uses a heat fixing process in which toner on a recording medium is fixed thereto by heating and melting the toner and applying a pressure to the melted toner. The heat fixing process is used to provide high-speed fixing and high-quality fixed images. However, toner heating in the heat fixing process consumes approximately half or more of total power consumed by the electrophotographic image forming apparatus.

In view of current environmental issues, a fixing device with low power consumption (an energy-saving fixing device) is desirable. Specifically, it is desirable to significantly lower the heating temperature to fix toner or eliminate the need for toner heating altogether. A non-heat fixing method in which toner is fixed onto a recording medium without heating the toner at all is ideal in having low power consumption.

One example of the non-heat fixing method is a wet fixing method. The wet fixing method uses an oil-in-water fixing agent in which an organic compound that dissolves or swells toner and is insoluble or hardly soluble in water is dispersed in and mixed with water. The wet fixing method involves spraying or dropping of the oil-in-water fixing agent onto unfixed toner located at a predetermined position on the surface of an object, thereby dissolving or swelling the toner, and drying of the object.

However, the wet fixing method using such an oil-in-water fixing agent causes the following problem: When a large amount of the fixing agent is applied to unfixed toner, a recording medium (object) such as a transfer sheet absorbs water contained in the fixing agent, thereby causing creases and curls on the recording medium and significantly disturbing stable and high-speed conveyance of the recording medium, which is desirable for the image forming apparatus. When a drying device is used to evaporate and remove a large amount of water from the fixing agent applied to the recording medium, power consumption becomes comparable to that of the image forming apparatus using the heat fixing process.

As a fixing agent that does not repel water-repellent treated unfixed toner, there are lipid fixing agents prepared by dissolving a material that dissolves or swells toner in a lipid solvent. For example, one fixing agent is prepared by diluting (dissolving), for example, an aliphatic dibasic acid ester including a component that dissolves or swells a resin component, which is a constituent of toner, in a diluent (solvent) of nonvolatile dimethylsilicone.

Another example fixing agent is a fixing solution for use in a fixing method of easily and sharply fixing an electrostatically formed unfixed image onto an image reception sheet without causing image irregularity. The fixing solution is prepared by mixing 100 parts by volume of a solvent dissolving toner compatible with 8 to 120 parts by volume of a silicone oil.

Such lipid fixing agents include a lipid solvent having a high affinity with water-repellent treated unfixed toner, and therefore dissolve or swell and fix the water-repellent treated unfixed toner onto a recording medium without repelling the toner.

Each of the above-described fixing actions is performed by applying the fixing agent to an unfixed toner layer. Specifically, as illustrated in FIGS. 1A and 1B, a fixing agent is applied to an unfixed toner layer 3 on a recording medium 2 using an application roller 1 serving as a contact application unit. A fixing agent layer 4 is provided on the application roller 1. Arrow X shown in FIG. 1B indicates a direction of internal flow in the fixing agent layer 4. However, in this configuration, when the thickness of the fixing agent layer 4 on the application roller 1 is reduced to less than that of the unfixed toner layer 3 to apply a small amount of the fixing agent to the recording medium 2, unfixed toner particulates are attracted by the surface tension, which is exerted in a direction indicated by arrow Y shown in FIG. 1B, of the fixing agent layer 4 on the application roller 1 at a position where the application roller 1 separates from the recording medium 2, thereby causing offset of the toner particulates to the application roller 1 and image irregularity on the recording medium 2.

By contrast, as illustrated in FIG. 2, when the thickness of the fixing agent layer 4 on the application roller 1 is sufficiently greater than that of the unfixed toner layer 3, the surface tension of the fixing agent layer 4 on the application roller 1 directly exerted on the toner particulates becomes small at the position where the application roller 1 separates from the recording medium 2 due to the large amount of the fixing agent. Therefore, toner offset to the application roller 1 is prevented. However, since the large amount of the fixing agent is applied to the recording medium, the toner particulates flow onto the recording medium 2 due to the excessive fixing agent, thereby degrading image quality, prolonging drying time, and causing a problem in terms of fixing response.

In addition, the recording medium such as a paper sheet acquires a significant residual liquid feeling (a wet feeling obtained when a hand contacts the paper sheet). Also, when a large amount of the fixing agent containing water is applied to a cellulose-containing medium such as a paper sheet, the medium may curl up, thereby possibly jamming as it is conveyed through the image forming apparatus.

Therefore, in such application of the fixing agent using a roller, it is extremely difficult to achieve both light application (application of a small amount) of the fixing agent to a toner layer on a paper sheet for the purposes of improving fixing response, reducing a residual liquid feeling, and preventing curling of the paper sheet, and prevention of toner offset to the roller. Even with the contact application unit such as a die coating unit, a blade application unit, or a wire bar application unit, toner is offset to the contact application unit due to the surface tension of the fixing agent as the fixing agent is reduced to a small amount, thereby degrading the image quality.

As described above, with typical application of the fixing agent using the contact application unit, it is extremely difficult to achieve both light application of the fixing agent to the toner layer on a paper sheet for the purpose of improving fixing response, and uniform application of the fixing agent without causing image irregularity. Such a problem occurs in any configuration involving applying a liquid fixing agent to a layer of resin-containing particulates on a medium, as well as the toner on a recording medium.

SUMMARY OF THE INVENTION

Described herein is a novel fixing device that includes an application unit to apply a foam-like fixing agent including a softener to particulates including a resin on a medium, the softener softening the particulates by at least partially dissolving or swelling the resin, and a thickness control unit to control a layer thickness of the foam-like fixing agent such that an application time during which the foam-like fixing agent is applied to the particulates is not shorter than a penetration time required for the foam-like fixing agent to penetrate through a layer of the particulates to the medium.

Further described herein is a novel fixing device that includes an application unit to apply a foam-like fixing agent, having a predetermined layer thickness including a softener, to particulates including a resin on a medium, the softener softening the particulates by at least partially dissolving or swelling the resin, and a control unit to control the application unit, such that an application time during which the foam-like fixing agent is applied to the particulates is not shorter than a penetration time required for the foam-like fixing agent to penetrate through a layer of the particulates to the medium.

Further described herein is a novel image forming method that includes forming an unfixed toner image on a medium by an electrostatic recording process using a developing agent containing particulates including a resin and a coloring agent and fixing the unfixed toner image onto the medium by applying a foam-like fixing agent to the unfixed toner image on the medium using the fixing device described above.

Further described herein is a novel image forming apparatus that includes an image forming unit configured to form an unfixed toner image on a medium by an electrostatic recording process using a developing agent containing particulates including a resin and a coloring agent and a fixing unit configured to fix the unfixed toner image onto the medium by applying a foam-like fixing agent to the unfixed toner image on the medium using the fixing device described above.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1A:
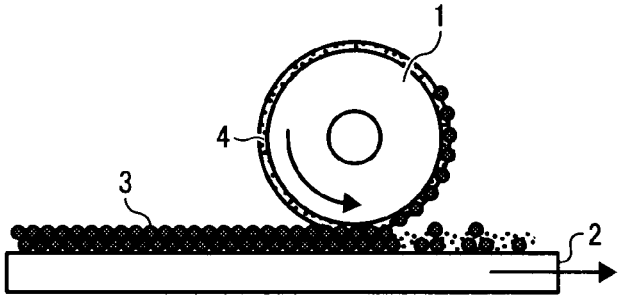
FIG. 1A BACKGROUND ART
FIGS. 1A and 1B are schematic cross-sectional diagrams illustrating toner offset occurring in a typical fixing device.
Figure 1B:
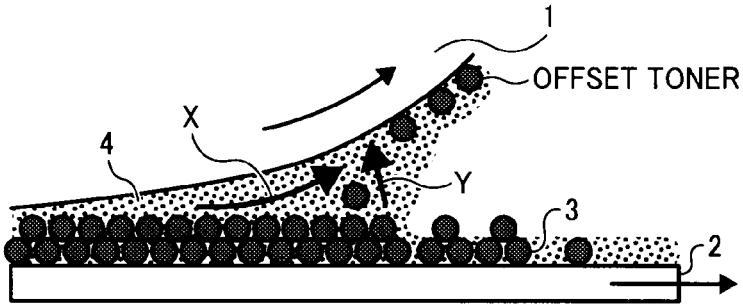
FIG. 1B BACKGROUND ART
Figure 2:
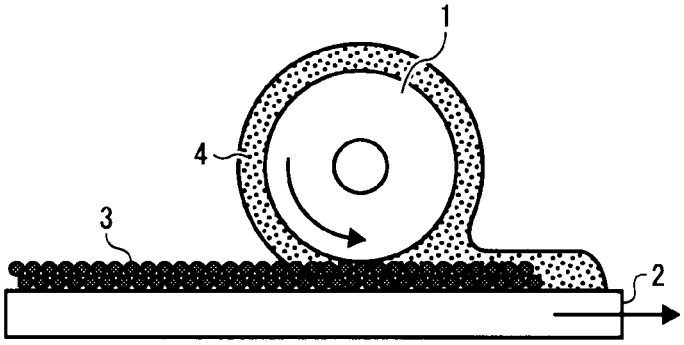
FIG. 2 BACKGROUND ART
FIG. 2 is a schematic cross-sectional diagram illustrating fixing in the typical fixing device when a thickness of a fixing agent layer on an application roller is sufficiently greater than a thickness of an unfixed toner layer.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve a similar result.

Figure 7A:
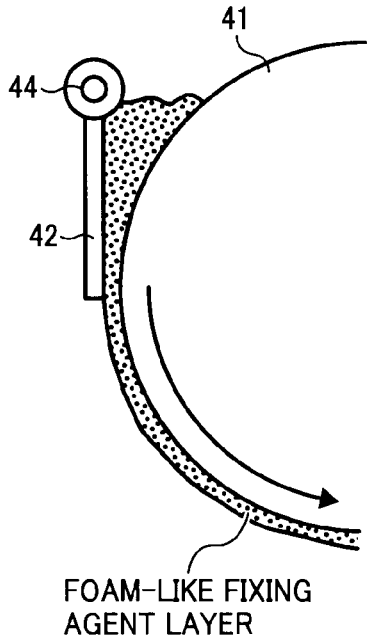
FIGS. 7A and 7B are schematic diagrams illustrating thickness control of the foam-like fixing agent on an application roller using an agent layer applicator blade.
Figure 7B:
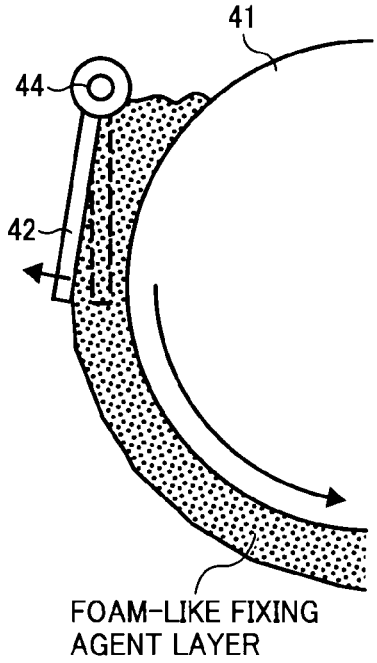

Referring now to the drawings, wherein like reference numerals designate identical or corresponding parts throughout the several views thereof, particularly to FIGS. 7A and 7B, fixing devices according to exemplary embodiments of the present invention are described.

Figure 3:
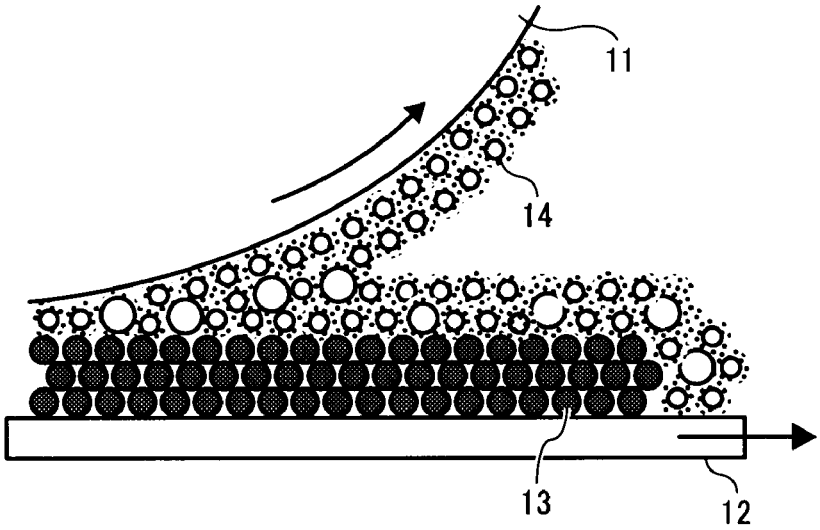
FIG. 3 is a schematic cross-sectional diagram illustrating example fixing of resin-containing particulates after a fixing agent is applied according to the present invention.
Figure 4:
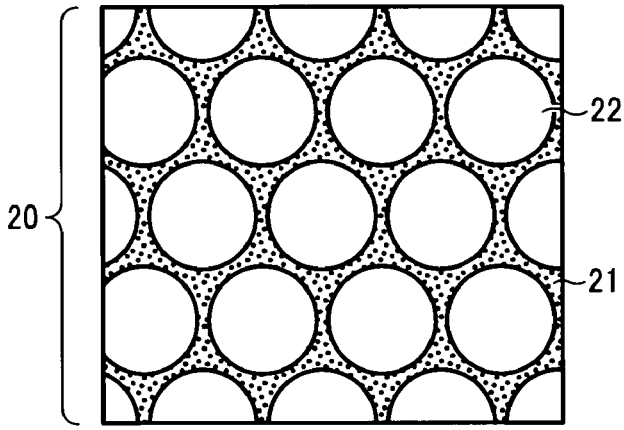
FIG. 4 is a schematic cross-sectional diagram illustrating an example configuration of a foam-like fixing agent.

As illustrated in FIG. 3, a foam-like fixing agent generation unit generates a foam-like fixing agent 14, which is a fixing agent including foams, thereby decreasing a bulk density of the fixing agent and increasing the thickness of the fixing agent layer on an application roller 11. Further, an effect of the surface tension of the fixing agent is reduced, thereby preventing offset of resin-containing particulates to the application roller 11. When the diameter of the resin-containing particulates is approximately 5 to 10 μm, the foam-like fixing agent 14 has a foam diameter of approximately 5 to 50 μm to apply the foam-like fixing agent 14 to a resin-containing particulate layer 13 on a recording medium 12 without disturbing the resin-containing particulate layer 13. As illustrated in FIG. 4, a foam-like fixing agent 20 includes foams 22 and a liquid film border (hereinafter referred to as plateau border) 21 between the foams 22.

Generally, it is relatively easy to generate large foams with a diameter of approximately 0.5 to 1 mm in less than several seconds (less than 0.1 seconds) simply by, for example, agitation. A method of rapidly generating small foams with a desirable diameter of approximately 5 to 50 μm from large foams is derived from the fact that visually observable foams with a diameter larger than the desirable diameter are easily generated at high speed. That is, by applying a shear force to the large foams, the large foams are broken, thereby generating small foams with the desirable diameter faster than by foaming the liquid agent.

Figure 5:
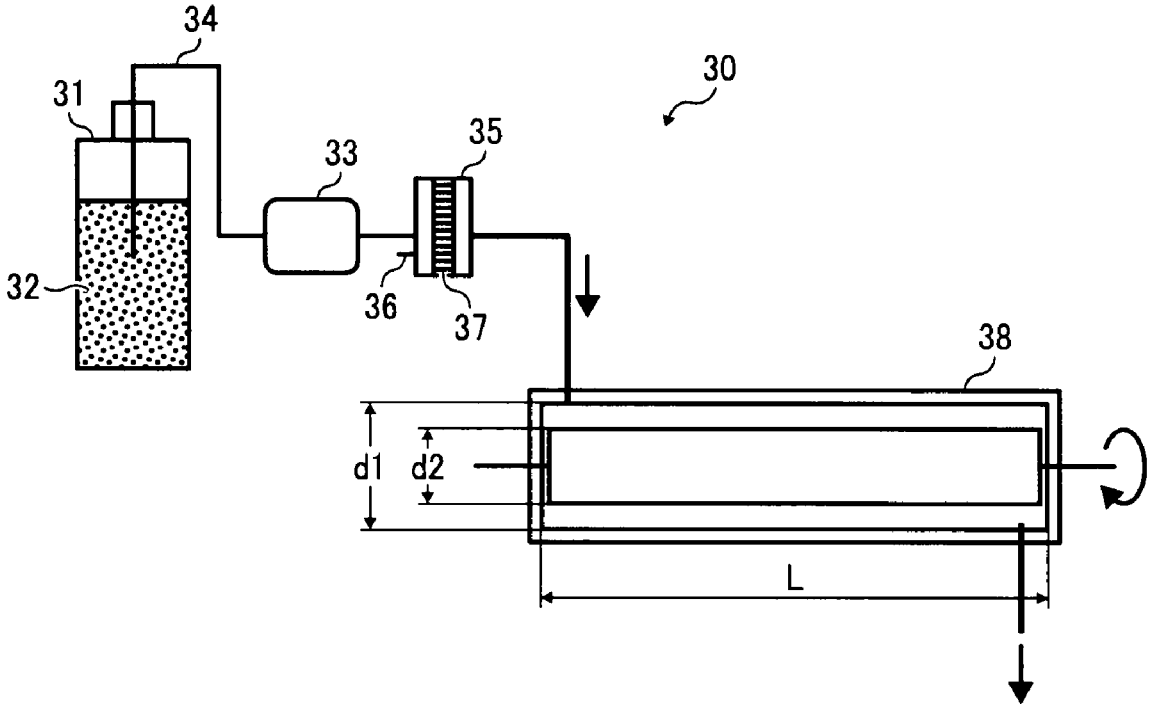
FIG. 5 is a schematic diagram illustrating an example configuration of a foam-like fixing agent generation unit in a fixing device according to the present invention.

A foam-like fixing agent generation unit 30 illustrated in FIG. 5 generates large foams and thereafter generates small foams by breaking the large foams. The large foams are generated by supplying a liquid fixing agent 32 in a fixing agent container 31 to a gas-liquid mixing unit 35 through a liquid transportation unit such as conveyance pumps 33 and 34. The gas-liquid mixing unit 35 includes an air opening 36. As the liquid flows, a negative pressure occurs at the air opening 36 and a gas is fed to the gas-liquid mixing unit 35 through the air opening 36, thereby mixing the liquid with the gas. The mixture is passed through a microporous sheet 37 to generate large foams with a uniform diameter. A preferable pore diameter of the microporous sheet 37 is approximately 30 to 100 μm. The microporous sheet is an interconnected porous member, not limited to the microporous sheet 37 illustrated in FIG. 5, and may be a sintered ceramic plate, a nonwoven fabric, or a resin foam sheet that has a pore diameter of approximately 30 to 100 μm. Another preferable method of generating large foams is to agitate the liquid fixing agent supplied by the conveyance pumps 33 and 34 and a gas supplied from the air opening 36 with a blade agitator and mix the liquid with foams or to cause bubbling in the liquid fixing agent supplied by the conveyance pumps 33 and 34 using, for example, an air supply pump.

The foam-like fixing agent generation unit 30 illustrated in FIG. 5 includes a small-foam generation unit 38 to apply a shear force to the large foams and break one large foam into two or more foams. The small-foam generation unit 38 includes closed double cylinders. The inner cylinder is rotatable. The fixing agent including large foams is supplied from a part of the outer cylinder to the small-foam generation unit 38 and receives a shear force from the rotating inner cylinder while passing through a space, which is a flow path, between the inner rotating cylinder and the outer cylinder. By applying the shear force, the large foams are changed to small foams. A foam-like fixing agent including foams with a desirable small diameter is discharged from an exit provided to the outer cylinder.

A liquid conveyance rate is determined by a number of rotations of the rotating inner cylinder and a length of the inner cylinder in a longitudinal direction thereof. A liquid conveyance rate V $mm^3$/sec for generating small foams is expressed by:

$$V=L\times\pi\times(d1^2-d2^2)/4/(1000/R),$$

where L (mm) is the length of the inner cylinder, d1 (mm) is the inner diameter of the outer cylinder, d2 (mm) is the outer diameter of the inner cylinder, and R (rpm) is the number of rotations.

For example, when L is 50 mm, d1 is 10 mm, d2 is 8 mm, and the number of rotations is 1,000 rpm, the liquid conveyance rate is approximately 1,400 $mm^3$/second (1.4 cc/second). When the amount of the foam-like fixing agent for fixing toner onto a sheet of A4 paper is 3 cc, a start-up time to generate the necessary amount of the foam-like fixing agent from the liquid fixing agent is approximately 2 seconds. Therefore, the foam-like fixing agent with the desirable foam diameter is generated at extremely high speed. The inner cylinder may be provided with a spiral groove to improve liquid conveyance in the cylinders.

By combining the large-foam generation unit changing the fixing agent from liquid to liquid including large foams and a small-foam generation unit generating small foams by applying a shear force to the large foams, the foam-like fixing agent having small foams with a foam diameter of approximately 5 to 50 μm is generated from the liquid fixing agent in an extremely short time.

A fixing agent application unit in a fixing device according to the present invention is now described.

Figure 6A:
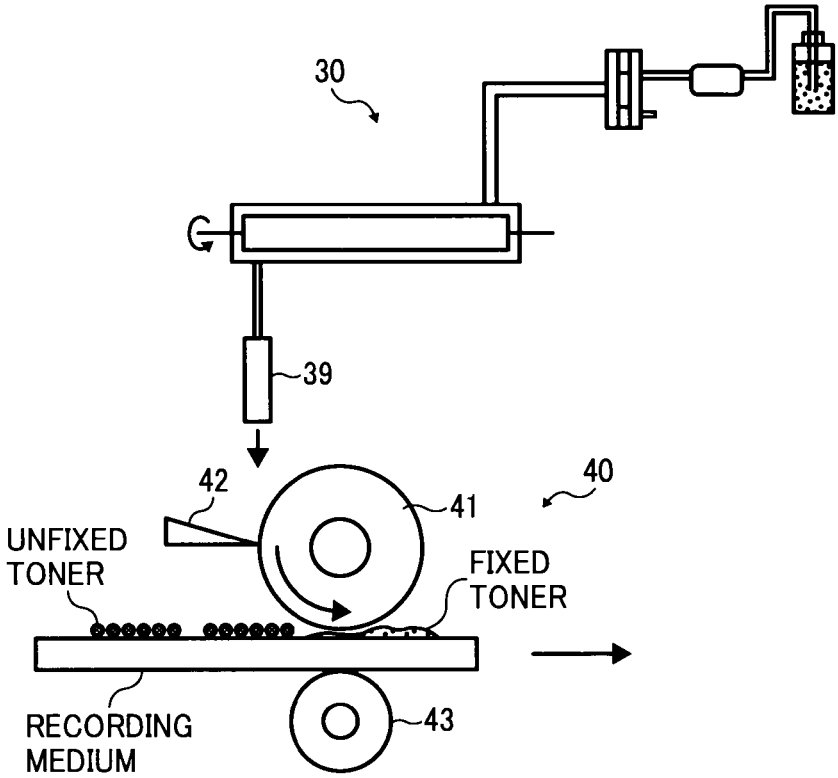
FIGS. 6A and 6B are schematic diagrams illustrating an example of a fixing agent application unit in the fixing device according to the present invention.
Figure 6B:
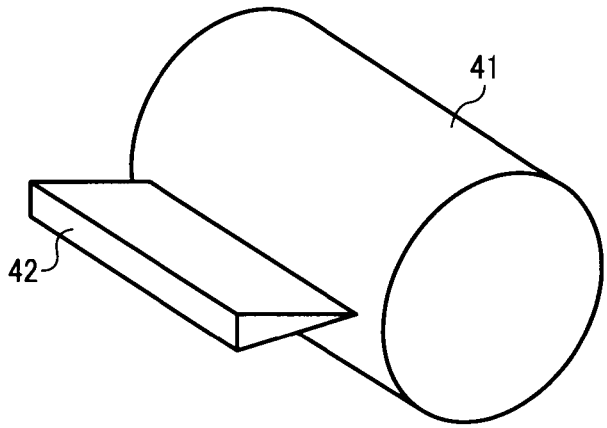

FIGS. 6A and 6B are schematic diagrams illustrating an example of the fixing agent application unit in the fixing device according to the present invention. The resin-containing particulates in the present invention are toner particulates. The fixing agent application unit 40 illustrated in FIG. 6A includes an application roller 41 that applies the foam-like fixing agent having desirable small foams generated by the above-described foam-like fixing agent generation unit 30 to a resin-containing particulate layer (toner particulate layer), a pressure roller 43 disposed opposite the application roller 41, and an agent layer applicator blade 42.

The agent layer applicator blade 42 is pressed against the surface of the application roller 41 to control the thickness of the foam-like fixing agent including the desirable small foams, thereby achieving an optimum thickness of the foam-like fixing agent. As illustrated in FIG. 6B, the layer of the foam-like fixing agent is formed on the application roller 41 using the agent layer applicator blade 42. The thickness of the fixing agent layer is optimized by the agent layer applicator blade 42 with respect to a time required for penetration of the foam-like fixing agent into the unfixed toner layer that depends on a foam size, foam viscosity, application pressure of the foam-like fixing agent, and thickness of the unfixed toner layer. By using the foam-like fixing agent applied by the fixing agent application unit 40 illustrated in FIG. 6A, the resin-containing particulates are prevented from being offset to the application roller 41. Since the bulk density of the foam-like fixing agent is extremely low, light application of the fixing agent containing a softening agent to the resin-containing particulate layer is achieved even when the foam-like fixing agent is thickly applied to the resin-containing particulate layer and the recording medium. As described above, the foam-like fixing agent including desirable small foams is generated by the foam-like fixing agent generation unit 30 including the large-foam generation unit generating large foams and the small-foam generation unit generating small foams by breaking the large foams with a shear force and dropped from an agent supply opening 39 to a point between the agent layer applicator blade 42 and the application roller 41.

The bulk density of the foam-like fixing agent is preferably in the range of approximately 0.01 to 0.1 g/cm$^3$. In addition, there is no need for the fixing agent to include foams in the fixing agent container 31. The fixing agent only needs to include foams at the time of application to the resin-containing particulate layer such as toner on the recording medium such as a paper sheet. It is desirable that the fixing agent in the fixing agent container 31 include no foams and a foam generation unit be provided at the point of supplying the fixing agent from the fixing agent container 31 or in the liquid conveyance path before the liquid is applied to the resin-containing particulate layer. By storing the liquid agent in the fixing agent container 31 and foaming the liquid agent after the liquid agent is discharged from the fixing agent container 31, the size of the fixing agent container 31 can be reduced.

The layer thickness of the foam-like fixing agent is controlled on the application roller 41 by using the agent layer applicator blade 42 as illustrated in FIGS. 7A and 7B. A gap is provided between the agent layer applicator blade 42 and the surface of the application roller 41. The gap is narrowed to reduce the layer thickness as illustrated in FIG. 7A and widened to increase the layer thickness as illustrated in FIG. 7B. The size of the gap is controlled by using a rotation shaft 44 provided at the end of the agent layer applicator blade 42 and including a driving unit. The optimum layer thickness is controlled to adjust a time required for penetration of the foam-like fixing agent into the unfixed toner layer that depends on an environmental temperature, foam size, foam viscosity, application pressure of the foam-like fixing agent, and thickness of the unfixed toner layer.

As a unit to convey the liquid fixing agent from the fixing agent container 31 to the foaming mechanism, the conveyance pumps in FIG. 5 are used. The conveyance pump may be a gear pump, a bellows pump, or a tube pump. However, pumps such as a gear pump may include a shaking mechanism or a rotation mechanism operating in the fixing agent, which may foam the fixing agent in the pump, make the fixing agent compressible, and therefore reduce the fluidity. In addition, mechanism elements included in the pumps such as a gear pump may contaminate the fixing agent, or the fixing agent may degrade the mechanism elements.

By contrast, the tube pump is preferable. The tube pump pushes out the liquid in the tube by deforming the tube. Therefore, only the tube contacts the fixing agent, and contamination of the fixing agent and degradation of the components of the pump are prevented by using a member having a resistance to the fixing agent. Also, the deformation of the tube does not cause foaming of the fixing agent and reduction in the fluidity.

A wire bar can be used as a substitute for the agent layer applicator blade 42 illustrated in FIGS. 7A and 7B. In this case, the thickness of the foam-like fixing agent on the application roller is controlled by the wire bar. The foam-like fixing agent is generated by a unit including a large-foam generation unit generating large foams and a unit breaking the large foams by applying a shear force thereto and dropped from an agent supply opening to a point between the wire bar and the application roller. By using the wire bar to control the agent layer thickness, a more uniform layer of the foam-like fixing agent can be achieved in the axial direction of the application roller than with the blade.

By using the foam-like fixing agent, fixing is performed with a small application amount and less image degradation in comparison with the liquid fixing agent. However, as the fixing rate increases, toner begins to be offset to the application roller. In principle, even with the foam-like fixing agent, particulates such as toner are offset to the contact application unit, thereby degrading the fixing.

Figure 8A:
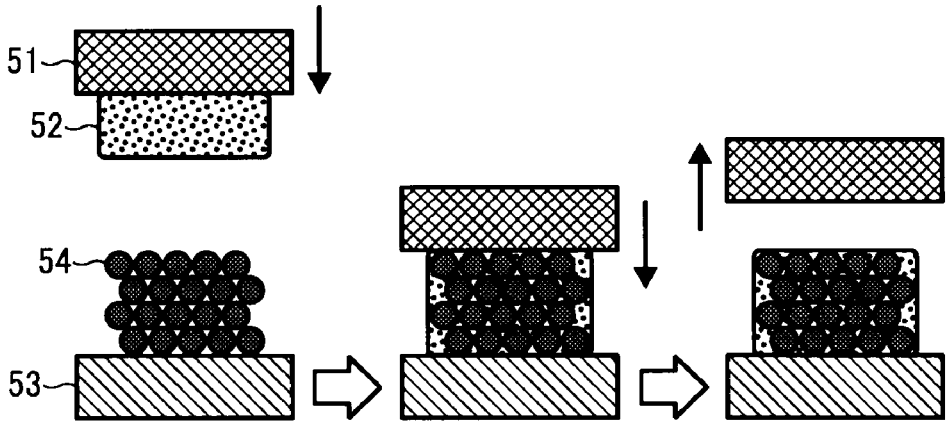
FIGS. 8A and 8B are schematic diagrams illustrating example models of offset of particulates such as toner to a contact application unit such as the application roller.
Figure 8B:
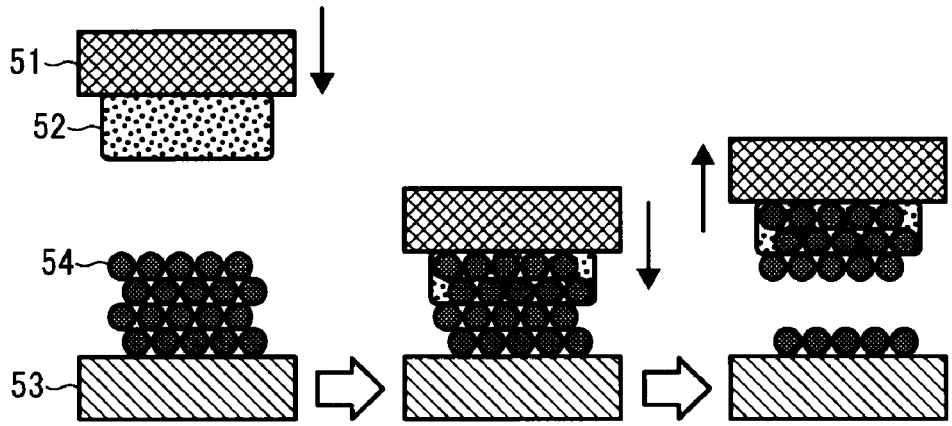

FIGS. 8A and 8B are schematic diagrams illustrating example models of offset of particulates such as toner onto a contact application unit such as an application roller. The application roller is liquid repellent and a medium such as a paper sheet is lyophilic, i.e., has an affinity for liquids. As illustrated in FIG. 8A, a fixing agent 52 on the contact application unit such as an application roller 51 contacts a toner layer 54 such as toner on a recording medium 53 such as a paper sheet and penetrates the toner layer 54. After the fixing agent 52 reaches the recording medium 53, binding forces are generated by the surface tension of the fixing agent 52 between toner particulates, between the toner particulates and the recording medium 53, and between the toner particulates and the application roller 51, respectively. In this case, since the application roller 51 is liquid repellent and the recording medium 53 is lyophilic, the binding force between the toner particulates and the recording medium 53 exceeds the other binding forces, thereby enabling removal of the application roller 51 without attachment of the toner to the application roller 51.

By contrast, as illustrated in FIG. 8B, after the fixing agent 52 on the application roller 51 contacts the toner layer 54 and before the fixing agent 52 reaches the recording medium 53, i.e., before the fixing agent 52 fully penetrates the toner layer 54 (the fixing agent has penetrated the toner layer 54 to a point intermediate between the application roller 51 and the recording medium 53), binding forces are generated by the surface tension of the fixing agent between toner particulates into which the fixing agent 52 has penetrated and between the toner particulates and the application roller 51, respectively. Since a binding force between dry toner particulates is weak, the toner layer 54 is divided at the dry toner particulates by removing the application roller 51 and the toner layer 54 is offset to the application roller 51, thereby causing image degradation.

According to the above-described models, significant offset of the resin-containing particulates such as toner to the contact application unit is prevented by setting a nip time, in which the foam-like fixing agent on the contact application unit such as an application roller contacts a layer of the resin-containing particulates on the recording medium such as a paper sheet, to be equal to or greater than a time in which the fixing agent penetrates through the particulate layer to the recording medium.

A nip part as used herein refers to a part in which the foam-like fixing agent on the contact application unit is in contact with the layer of the resin contain particulates on the medium such as a paper sheet, i.e., a part between a contact start point and a separation start point. The nip time is a time between the contact start point and the separation start point. A nip width refers to a length in the direction of conveying the medium of the nip part. A nip pressure is a pressure applied to the nip part, which is calculated by dividing a force applied to the nip part by an area of the nip part.

Figure 9:
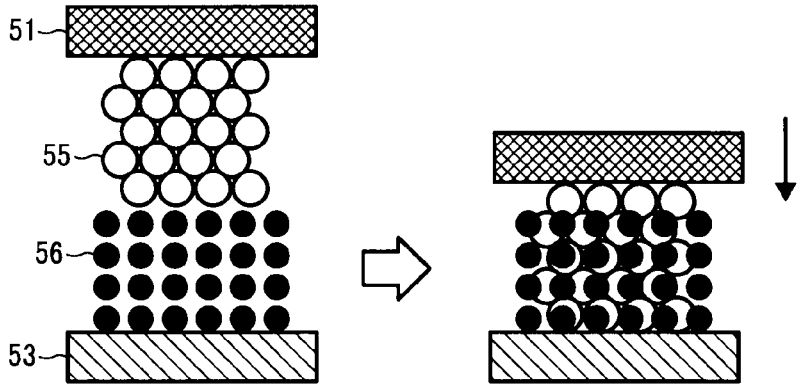
FIG. 9 is a schematic diagram illustrating a result of a large-scale model experiment using zirconia beads when a thickness of a foam layer is equal to a thickness of a particulate layer.

In a large-scale model experiment using 300 μm zirconia beads, penetration of a foam-like fixing agent into a resin-containing particulate layer is observed by an optical microscope. As a result, foams of a foam-like fixing agent 55 penetrate between zirconia particulates 56 without being broken as illustrated in FIG. 9. The foam-like fixing agent 55 contacting the zirconia particulates 56 penetrates between the zirconia particulates 56 while being pressed by the upper foams thereof. Generally, a liquid penetrates between particulates by capillary action caused by a surface tension of the liquid. However, observation reveals that foams and liquids penetrate differently. Specifically, foams act as a flexible continuum and the foams, which have penetrated between the particulates, continuously fill the gap between the particulates while being pressed by upper foams thereof. Although not actually observed but according to a similarity rule, it is presumed that, also with a layer of particulates with a diameter of 6 μm such as toner, the foams, which have penetrated between the particulates, continuously penetrate while being pressed by the upper foams thereof, similarly to the large-scale model experiment.

Figure 10:
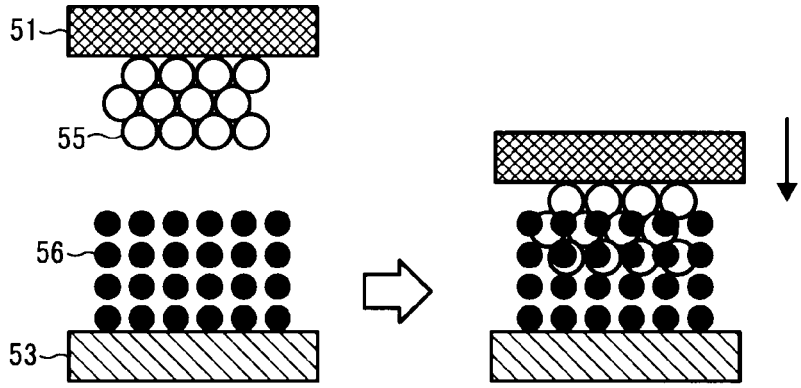
FIG. 10 is a schematic diagram illustrating a result of a large-scale model experiment using zirconia beads when the thickness of the foam layer is less than the thickness of the particulate layer.

In the large-scale model experiment, when the thickness of the foam layer is less than the thickness of the particulate layer, the force to press the foams stops at a halfway point and the foams cannot quickly reach the recording medium as illustrated in FIG. 10.

From the above-described experiment, it is also found that the thickness of the foam-like fixing agent on the application roller and the thickness of the resin-containing particulate layer on the medium are strongly associated with the penetration time in which the fixing agent penetrates the resin-containing particulate layer in actual scale.

A method of measuring a time from when the fixing agent starts to penetrate a layer of resin-containing particulates such as toner to when the fixing agent reaches the recording medium (which is defined as penetration time) is devised as described below, on the basis of which the relation between the nip time and the penetration time according to the present invention may now be described.

Figure 11:
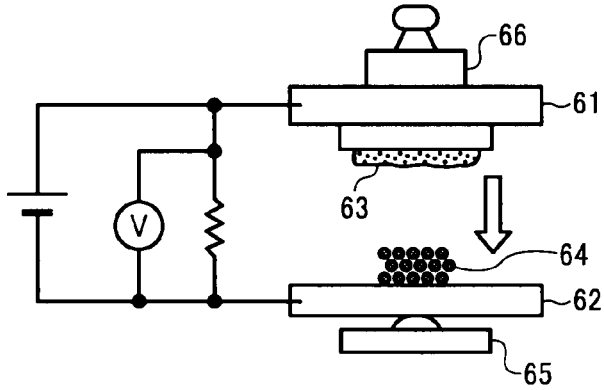
FIG. 11 is a schematic diagram illustrating an example of a penetration timer device.

FIG. 11 is a schematic diagram illustrating an example of a penetration timer device. This example uses a foam-like fixing agent as a fixing agent and toner as resin-containing particulates. The fixing agent is conductive, with a resistance of $10^7$ Ω·cm or less since the fixing agent includes ionic materials such as a foaming agent to foam the fixing agent and a dispersing agent. By using an upper electrode 61 as the contact application unit and a lower electrode 62 as the recording medium, a foam-like fixing agent layer 63 is formed on the upper electrode 61 and a toner layer 64 is formed on the lower electrode 62. To detect when the upper electrode 61 contacts the lower electrode 62, for example, a weight detection load cell 66 is disposed above the upper electrode 61, a weight detection load cell 65 is disposed below the lower electrode 62, and a voltage is applied between the upper and lower electrodes 61 and 62. When the upper electrode 61 contacts the lower electrode 62, the weight detection load cell 65 detects the weight of the upper electrode 61 and determines a contact start point. Thereafter, an electrical current flows between the upper and lower electrodes 61 and 62 when the foam-like fixing agent 63 reaches the lower electrode 62 via the toner layer 64, thereby changing the applied voltage. Therefore, the penetration time is measured by measuring the time from when the weight detection load cell 65 detects the weight to when the voltage starts to change.

Next, measurement examples of measuring the penetration time using the penetration timer device illustrated in FIG. 11 are described below.

MEASUREMENT EXAMPLE 1

Foam-like fixing agent layer: Foam layers of various thicknesses are formed on the upper electrode. An average foam diameter is 20 μm and a bulk density is 0.05 g/cm$^3$.

Toner layer: A toner layer of spherical toner particulates with an average diameter of 6 μm is formed on the lower electrode. The toner layer has a thickness of 30 μM.

The upper and lower electrodes are formed of a stainless steel SUS 304 according to JIS (Japanese Industrial Standard). The upper electrode is fixed to a linear stage and contacts the lower electrode at a pressure of 0.03 kgf/cm$^2$ (application pressure). To prevent electrolysis of the fixing agent from occurring between the electrodes, a voltage of 0.8 V is applied between the electrodes.

Figure 12:
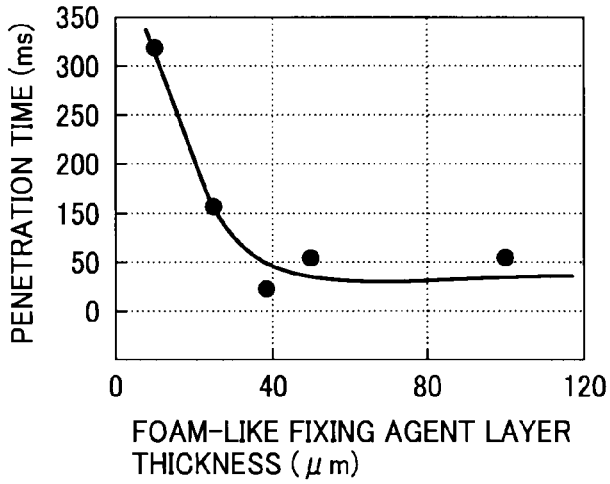
FIG. 12 is a graph illustrating a measurement result of penetration time with respect to thickness of a foam-like fixing agent layer formed on an upper electrode.

FIG. 12 shows the measurement result of the penetration time with respect to the thickness of each foam-like fixing agent layer formed on the upper electrode. As illustrated in FIG. 12, when the thickness of the foam-like fixing agent layer is equal to or more than the thickness of the toner layer, the penetration time is approximately the same. When the thickness of the foam-like fixing agent layer is less than the thickness of the toner layer, the penetration time becomes longer as the foam-like fixing agent layer is thinned. The result supports the supposition that the foams, which enter a gap in the toner layer, penetrate the gap while continuously being pressed by the upper foams thereof to the extent of the thickness of the foam layer as illustrated in FIGS. 9 and 10.

MEASUREMENT EXAMPLE 2

Foam-like fixing agent layer: a foam layer with an average foam diameter of 20 μm, a bulk density of 0.05 g/cm$^3$, and a thickness of 50 μm is formed on the upper electrode.

Toner layer: A toner layer of spherical toner particulates with an average diameter of 6 μm is formed on the lower electrode. The toner layer has a thickness of 30 μm.

The upper and lower electrodes are formed of a stainless steel SUS 304. The upper electrode is fixed to a linear stage and contacts the lower electrode at various pressures (application pressure). To prevent electrolysis of the fixing agent from occurring between the electrodes, a voltage of 0.8 V is applied between the electrodes.

Figure 13:
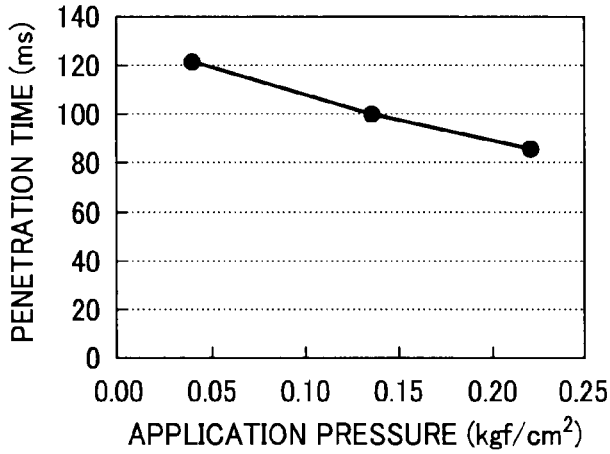
FIG. 13 is a graph illustrating a measurement result of penetration time with respect to application pressure.

FIG. 13 shows the measurement result of the penetration time with respect to the pressure (application pressure). As illustrated in FIG. 13, the penetration time decreases as the application pressure increases, which supports the supposition that the foams penetrating the gap in the toner layer penetrate at high speed and the penetration time decreases as the force of the upper foams thereof to press the foams increases.

MEASUREMENT EXAMPLE 3

Foam-like fixing agent layer: a foam layer with an average foam diameter of 20 μm, a bulk density of 0.05 g/cm$^3$, and a thickness of 50 μm is formed on the upper electrode.

Toner layer: A toner layer of spherical toner particulates with an average diameter of 6 μm is formed on the lower electrode. The toner layer has a thickness of 30 μm.

The upper and lower electrodes are formed of a stainless steel SUS 304. The upper electrode is fixed to a linear stage and contacts the lower electrode at a pressure of 0.03 kgf/cm$^2$ (application pressure). To prevent electrolysis of the fixing agent from occurring between the electrodes, a voltage of 0.8 V is applied between the electrodes.

Figure 14:
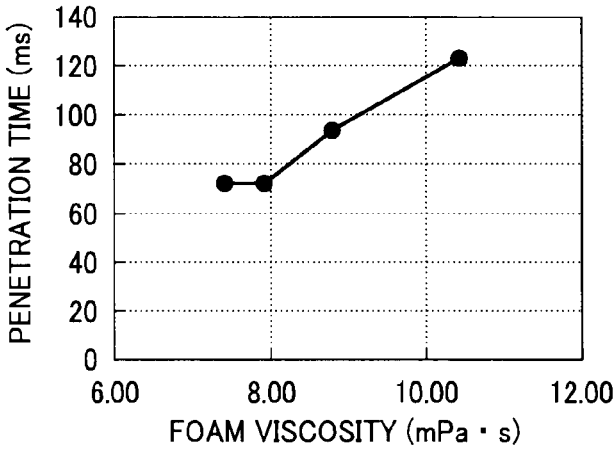
FIG. 14 is a graph illustrating a measurement result of penetration time with respect to foam viscosity of a foam-like fixing agent.

FIG. 14 shows the penetration time with respect to various foam viscosities of the foam-like fixing agent. In the present invention, the foam viscosity is measured by using a cone-plate rotational viscometer with the outer diameter of a rotor of 60 mm, a cone angle of 1 degree, and a gap between a cone and a plate of 3 mm. The value of rotational viscosity measured at a liquid temperature of 25° C. and after 10 seconds of rotation at a rotation rate of 10 rotations per second is used as the foam viscosity.

As can be seen in FIG. 14, the penetration time decreases as the foam viscosity is reduced, which supports the supposition that the penetration rate increases and the penetration time decreases as the foam becomes flexible when the upper foams continuously press the foams penetrating the gap in the toner layer.

According to the above-described analysis, the resin-containing particulates are prevented from being offset to the contact application unit by setting the nip time in which the foam-like fixing agent on the contact application unit contacts the resin-containing particulate layer on the medium to be equal to or greater than the penetration time in which the foam-like fixing agent reaches the medium through the resin-containing particulate layer.

In addition, according to the measurement examples described above, when the resin-containing particulates are toner particulates with a diameter of approximately 5 μm, the penetration time ranges from approximately 50 to 300 milliseconds for each foam-like fixing agent and under each of the application conditions. Therefore, a preferable nip time in which the foam-like fixing agent on the contact application unit contacts the resin-containing particulate layer on the recording medium such as a paper sheet is at least in the range of 50 to 300 milliseconds.

Figure 15:
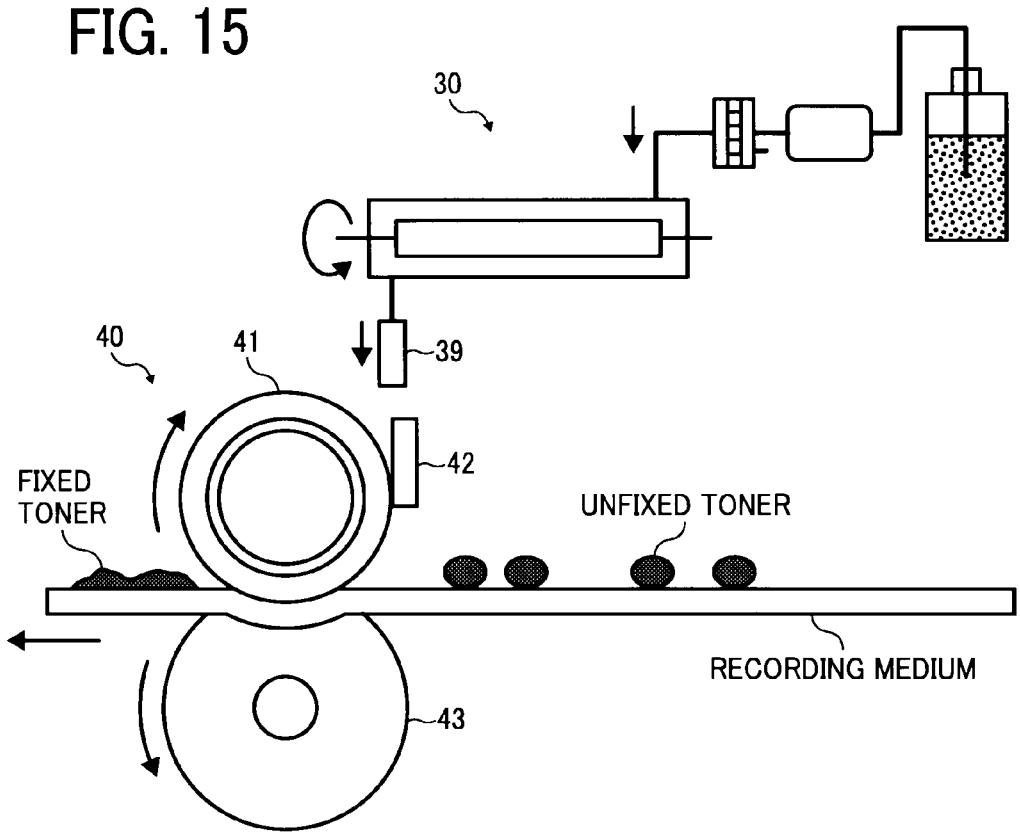
FIG. 15 is a schematic diagram illustrating an example configuration of the fixing device according to the present invention.

FIG. 15 is a schematic diagram illustrating an example configuration of the fixing device according to the present invention. The fixing device is an example that ensures the nip time of 50 to 300 milliseconds. In this example, the resin-containing particulates are toner and the recording medium is a paper sheet. The nip time is calculated by dividing a nip width by a conveyance rate of a paper sheet. The conveyance rate is obtained by using design data of a drive mechanism for conveying paper sheets. The nip width is obtained by pinching a paper sheet between the application roller 41, which is entirely colored with a non-dry pigmented coating, and the pressure roller 43 opposing the application roller 41, pressing the paper sheet therebetween (without rotating the rollers) to attach the pigmented coating to the paper sheet, and measuring a length of the colored portion (generally colored in a rectangular shape) of the paper sheet in the direction of conveying the paper sheet. By adjusting the nip width according to the conveyance rate, the nip time is set to be equal to or greater than the penetration time. At least one of the application roller 41 and the pressure roller 43 includes a porous elastic body (porous elastic layer). In the example illustrated in FIG. 15, the pressure roller 43 includes a porous elastic body (hereinafter referred to as sponge). Therefore, the nip width is easily changed by changing a distance between the shafts of the application roller 41 and the sponge pressure roller 43 according to the conveyance rate. Although an elastic rubber is also suitable as a substitute for the sponge, the sponge is deformed by a force smaller than with the elastic rubber, thereby ensuring a long nip width without excessively increasing the pressure force applied by the application roller 41.

The fixing agent contains an agent to soften or swell resin, which may cause problems such as softening the sponge of the pressure roller 43 when the fixing agent is attached to the pressure roller 43. Therefore, it is preferable that a resin material of the sponge is not softened or swollen by the softening or swelling agent. The sponge pressure roller 43 may be covered with a flexible film. When the pressure roller 43 including a sponge material that deteriorates with the softening or swelling agent is covered with the flexible film that is not softened or swollen by the softening or swelling agent, degradation of the sponge pressure roller 43 can be prevented. Preferable sponge materials include a resin porous body of, for example, polyethylene, polypropylene, or polyamide. The flexible film for covering the sponge is preferably formed of polyethylene telephthalate, polyethylene, polypropylene, or polytetrafluoroethylene-perfluoroalkyl vinyl ether copolymer (PFA).

In the configuration illustrated in FIG. 15, the application roller 41 continuously contacts the sponge pressure roller 43. In this case, the foam-like fixing agent on the application roller 41 may be attached to and contaminate the sponge pressure roller 43 when the paper sheet is not conveyed. To prevent such a problem, it is preferable that a detection unit, not shown, that detects a leading end of a paper sheet before the paper sheet is conveyed to the application roller 41 be provided and the foam-like fixing agent be timely formed on the application roller 41 based on a detection signal produced by the detection unit so that the fixing agent is applied only from the leading end to the trailing end of the paper sheet.

In addition, in FIG. 15, it is preferable that the application roller 41 be separated from the sponge pressure roller 43 while not in use and the application roller 41 contact the sponge pressure roller 43 in applying the fixing agent in response to the detection signal from the detection unit detecting the leading end of a paper sheet by using a drive mechanism, not shown. In this case, it is also preferable that the trailing end of the paper sheet be detected to separate the application roller 41 from the sponge pressure roller 43 in response to detection of the trailing end.

As described above, the penetration time decreases as the nip pressure (the force applied to the nip part divided by the area of the nip part) of the nip part increases, as can be seen from the measurement result shown in FIG. 13. Therefore, in FIG. 15, as the nip pressure increases, the nip time decreases to the extent of not causing image degradation and the conveyance rate is increased for the same nip width, thereby enabling high-speed fixing. A preferred unit for adjusting the nip pressure includes a mechanism that changes a distance between the axial shafts of the application roller and the pressure roller.

As can be seen from the measurement result shown in FIG. 14, the penetration time also changes depending on the foam viscosity of the foam-like fixing agent. When the nip time and the nip pressure are constant, an increase in the foam viscosity due to a change in formulation of the fixing agent or a reduction in the temperature of the usage environment causes the penetration time to exceed the nip time and thereby cause image degradation. To prevent such a problem, it is preferable to adjust the nip time to be equal to or greater than the penetration time according to the foam viscosity of the foam-like fixing agent by using the fact that the penetration time is changed by the nip pressure. The foam viscosity of the foam-like fixing agent is detected in the fixing device. The rotational viscosity measured using the cone-plate rotational viscometer is used as the foam viscosity as described above. It is preferable that a detection unit of the foam viscosity use a measurement principle close to that of the cone-plate rotational viscometer. For example, in FIG. 15, a preferred detection unit detects a motor torque applied to a rotor disposed in a passage pipe through which the desirable foam-like fixing agent passes toward the agent supply opening so that the motor torque is used as a foam viscosity as a substitute for the rotational viscosity. Another preferred detection unit is a cantilever oscillator provided to detect a change in the characteristic frequency, which is used as a foam viscosity as a substitute for the rotational viscosity. A distance between the shafts of the application roller and the pressure roller is preferably changed according to a signal indicating detection of the foam viscosity.

As illustrated in FIG. 12, to reduce the penetration time as much as possible, it is preferable that the thickness of the foam-like fixing agent layer on the contact application unit be equal to or more than the thickness of the toner layer. The same is true of other resin-containing particulates.

When the resin-containing particulates are toner particulates forming a color image, the thickness of a toner layer on a paper sheet varies depending on colors and brightness of the image. Then, the thickness of the foam-like fixing agent layer is determined using a maximum value of the thickness of the toner layer attached to the paper sheet as a standard. The maximum value of the toner layer is obtained from image signals. The thickness of the foam-like fixing agent layer is adjusted to be equal to or more than the maximum thickness of the toner layer by, for example, controlling the gap between the application roller and the agent layer applicator blade in the fixing device illustrated in FIG. 15 (see FIGS. 7A and 7B). In various image forming apparatuses, the thickness of the toner layer attached to the paper sheet is determined by a value calculated based on a setting table according to image signals sent from a scanner or a personal computer. The thickness of the foam-like fixing agent layer on the application roller is adjusted to be equal to or more than the maximum set value of the toner layer attached to the paper sheet based on the image signals.

When the thickness of the toner layer varies, the penetration time varies (the penetration time increases as the thickness of the toner layer increases). Therefore, it is preferable that the nip time in which the foam-like fixing agent on the application roller is in contact with the toner layer on the paper medium be variable according to the thickness of the toner layer. As a unit to change the nip time, a unit that changes the conveyance rate of paper sheets or changes the nip width is preferable. The nip time is equal to or greater than the penetration time by calculating a maximum thickness of a toner layer on a paper sheet from image signals, converting the maximum thickness into the penetration time, and changing the nip width or the conveyance rate.

Figure 16:
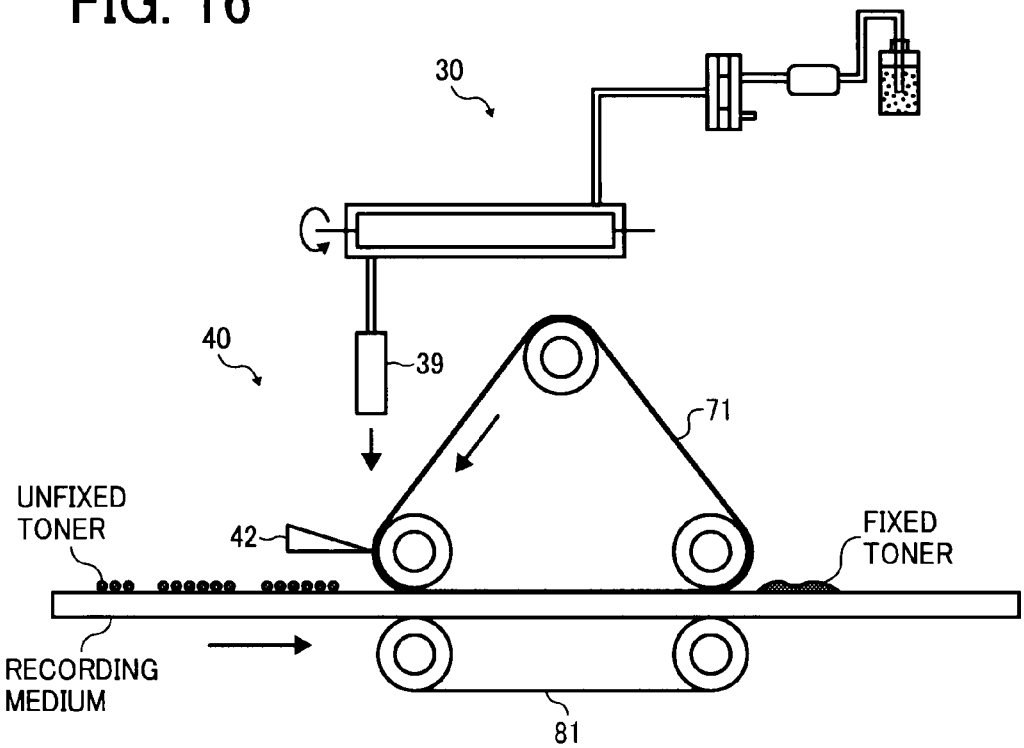
FIG. 16 is a schematic diagram illustrating another example configuration of the fixing device according to the present invention.

Another configuration of the fixing device according to the present invention is now described. As illustrated in FIG. 16, instead of using the application roller 41 illustrated in FIG. 15, an application belt 71 may be used to apply the fixing agent to unfixed toner on a recording medium. In addition, a pressure belt 81 is used as a substitute for the pressure roller 43. A foam-like fixing agent including small foams is generated by the foam-like fixing agent generation unit 30 including a large-foam generation unit generating large foams and a small-foam generation unit breaking the large foams by applying a shear force thereto. The foam-like fixing agent including foams with the desirable foam diameter is supplied from the agent supply opening 39. The thickness of the foam-like fixing agent layer on the application belt 71 is controlled by controlling the gap between the agent layer applicator blade 42 and the application belt 71, thereby achieving an optimum thickness of the foam-like fixing agent. As the application belt 71, a member including a substrate, such as a seamless nickel belt or a seamless polyethylene terephthalate (PET) film, coated with a releasing fluororesin such as PFA is used.

Figure 17:
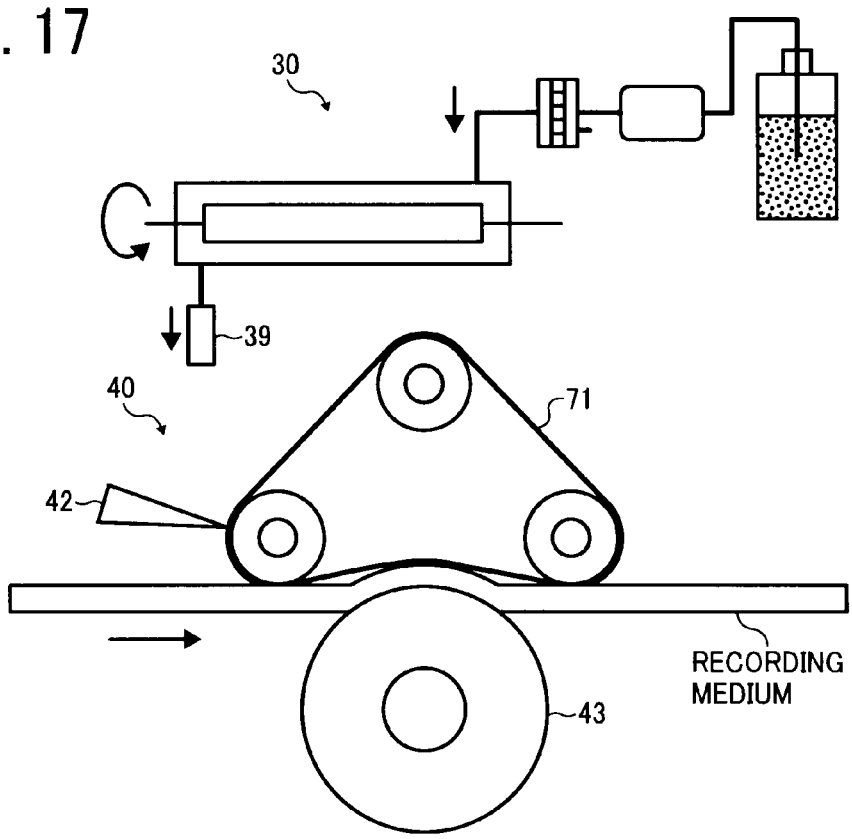
FIG. 17 is a schematic diagram illustrating another example configuration of the fixing device according to the present invention.

The nip width is easily widened by using the application belt 71. The configuration using the application belt 71 is not limited to the configuration illustrated in FIG. 16. It is also preferable that a roller be used instead of a belt on the pressing side as illustrated in FIG. 17. Also, it is preferable that a roller be used on the application side and a belt be used on the pressing side, as illustrated in FIG. 18.

Figure 18:
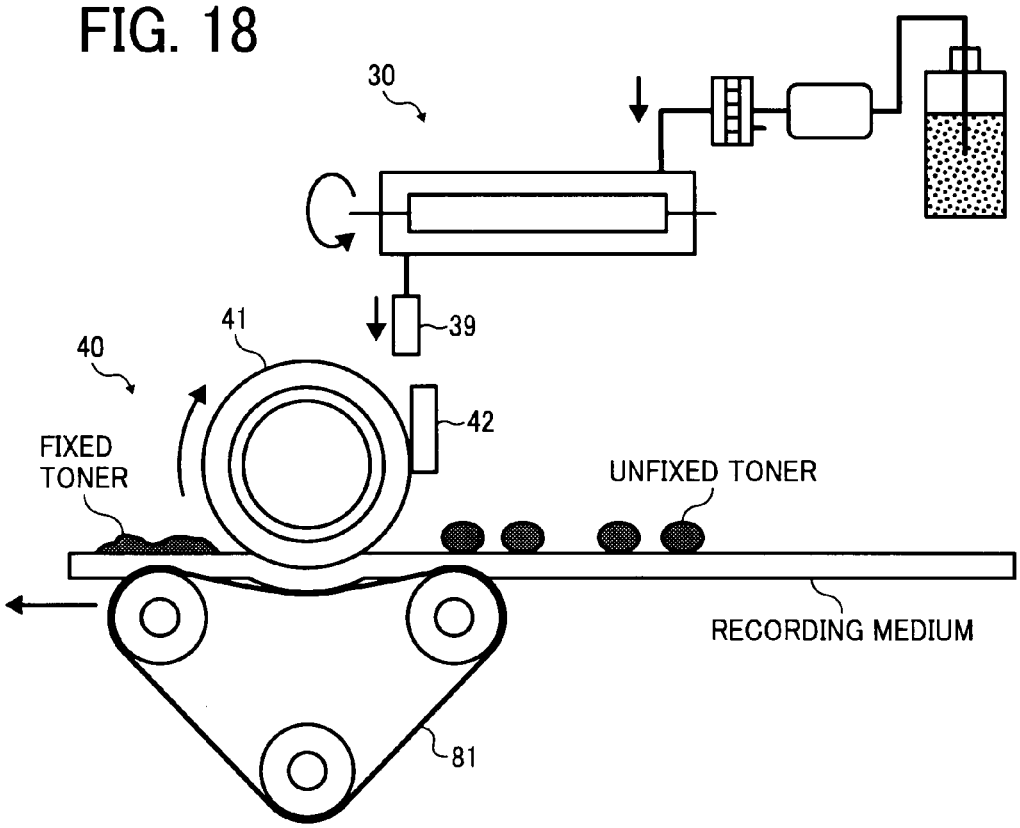
FIG. 18 is a schematic diagram illustrating another example configuration of the fixing device according to the present invention.

As illustrated in FIGS. 16 to 18, by using a belt on at least one of the application side and the pressing side, the nip width is easily widened, an unnecessary force causing a crease on a paper sheet is not generated, and the conveyance rate of paper sheets is increased for the same nip time, thereby enabling high-speed fixing.

Formulation of the fixing agent is now described.

The foam-like fixing agent includes foams in the liquid containing a softening agent as described above. It is preferable that the liquid containing the softening agent include a foaming agent or a foam-increasing agent to have a foam-like configuration including foams in stable condition and with an even size as much as possible. In addition, it is preferable that the fixing agent contain a thickening agent since foams are dispersed in the liquid in stable condition with a high level of viscosity.

As a foaming agent, anionic surfactants, in particular, fatty acid salts are preferable. The surface activity of fatty acid salt reduces the surface tension of the water-containing fixing agent and therefore facilitates foaming of the fixing agent. In addition, a lamellar layer of fatty acid salt is formed on the foam surface, thereby strengthening the foam wall (plateau border) in comparison with other surfactants and extremely increasing foam stability. Also, it is preferable that the fixing agent contain water to make a foaming property of the fatty acid salt effective. As fatty acid salts, saturated fatty acid salts with a resistance to oxidation are preferable in view of their long-term stability in atmosphere. When the fixing agent including a saturated fatty acid salt contains a slight amount of unsaturated fatty acid salt, solubility and dispersibility of the fatty acid salt in water is improved and the foaming property thereof is improved at a low temperature of 5 to 15° C. Also, stable fixing is achieved over a wide environmental temperature range and the fatty acid salt in the fixing agent is prevented from separating while the fixing agent is left for a long time.

As a fatty acid used for the saturated fatty acid salt, saturated fatty acids with a carbon number of 12, 14, 16, or 18, such as lauric acid, myristic acid, palmitic acid, and stearic acid, are suitable. The saturated fatty acid salts with a carbon number of 11 or less have a strong odor and therefore are not suitable for use in an image forming apparatus using the fixing agent in offices or homes. By contrast, the saturated fatty acid salts with a carbon number of 19 or more have a low solubility in water and an extremely low stability while the fixing agent is left. Therefore, one or a mixture of the saturated fatty acid salts obtained from the saturated fatty acids with a carbon number of 12, 14, 16, or 18 is used as the foaming agent.

Also, unsaturated fatty acid salts may be used in the foaming agent. The unsaturated fatty acids with a carbon number of 18 and one to three double bond(s) are preferable. Specifically, oleic acid, linoleic acid, and linolenic acid are suitable. The unsaturated fatty acids that include four or more double bonds are strongly reactive, and therefore the stability of the fixing agent while being left deteriorates. Therefore, one or a mixture of the unsaturated fatty acid salts obtained from the unsaturated fatty acids with a carbon number of 18 and one to three double bond(s) is used as the foaming agent. Alternatively, a mixture of the above-described saturated fatty acid salts and the above-described unsaturated fatty acid salts may be used as the foaming agent.

Further, as for the above-described saturated fatty acid salts or the above-described unsaturated fatty acid salts used as the foaming agent of the fixing agent, sodium salts, potassium salts, or amine salts are preferable. In view of the commercial value of the fixing device, it is preferable that the fixing device become capable of fixing immediately after the fixing device is powered on. The fixing device becomes capable of fixing by generating the desirable foam-like fixing agent. Since the above-described fatty acid salts quickly foam the fixing agent, the fixing device becomes capable of fixing shortly after the fixing device is powered on. In particular, by using amine salts, the fixing agent is foamed with a shear force applied thereto in a minimum time and therefore the foam-like fixing agent is easily prepared. In this case, the fixing device becomes capable of fixing in a minimum time after the fixing device is powered on.

The softening agent that softens resin by dissolving or swelling the resin includes aliphatic esters. The aliphatic esters are excellent in at least partially dissolving or swelling the resin contained in, for example, toner.

Also, the softening agent preferably has an acute oral toxicity LD50 of more than 3 g/kg, more preferably, of 5 g/kg in view of safety for a human body. Aliphatic esters have a high level of safety for a human body as can be seen from the fact that aliphatic esters are often used as cosmetic materials.

Since fixing of toner onto a recording medium is performed in an apparatus frequently used in a closed environment and the softening agent remains in the toner after the fixing, it is preferable that the fixing be performed without generating volatile organic compounds (VOC) and unpleasant odors. That is, it is preferable that the softening agent does not contain volatile organic compounds and substances causing unpleasant odors. Aliphatic esters have high boiling points, are low-volatile, and do not have irritating odors, in comparison with widely used organic solvents (such as toluene, xylene, methyl ethyl ketone, or ethyl acetate).

As a useful scale for highly accurate measurement of odors performed in, for example, office environment, an odor index (10×log(a dilution ratio of a substance at which the odor of the substance stops being sensed)) determined by a triangle odor bag method, which is sensory measurement, provides an indication of odors. The odor index of the aliphatic ester contained in the softening agent is preferably 10 or less. In this case, unpleasant odors are not sensed in normal office environment. Further, it is preferable that other agents contained in the fixing agent do not have unpleasant and irritating odors as well as the softening agent.

In the fixing agent according to the present invention, the above-described aliphatic esters preferably include saturated aliphatic esters. The aliphatic esters including saturated aliphatic esters improve storage stability (resistance to oxidation and hydrolysis) of the softening agent. Also, saturated aliphatic esters have a high level of safety for a human body and many of the saturated aliphatic esters dissolve or swell resin contained in toner in one second. Further, saturated aliphatic esters reduce stickiness of toner to a recording medium. This is considered to be due to an oil film formed on the surface of the dissolved or swollen toner by saturated aliphatic esters.

In the fixing agent according to the present invention, the above-described saturated aliphatic esters preferably include a compound expressed by a general formula: R1COOR2, where R1 is an alkyl group with a carbon number of 11 to 14 and R2 is a linear or a branched alkyl group with a carbon number of 1 to 6. When the carbon numbers of R1 and R2 are less than the desirable numbers, odors are generated. When the carbon numbers of R1 and R2 are more than the desirable numbers, the resin softening ability is reduced.

When the above-described saturated aliphatic esters include the above-described compound expressed by R1COOR2, the ability to dissolve or swell resin contained in toner is improved. Also, the above-described compound has an odor index of 10 or less and does not have unpleasant and irritating odors.

Aliphatic monocarboxylic acid esters included in the above-described compound are, for example, ethyl laurate, hexyl laurate, ethyl tridecylate, isopropyl tridecylate, ethyl myristate, and isopropyl myristate. Many of these aliphatic monocarboxylic acid esters dissolve in a lipid solvent but do not dissolve in water. Therefore, in an aqueous solvent, the fixing agent contains glycols as a dissolution auxiliary agent so that many of these aliphatic monocarboxylic acid esters are dissolved or in microemulsion form.

In the fixing agent according to the present invention, the above-described aliphatic esters preferably include aliphatic dicarboxylic acid esters. The aliphatic esters including aliphatic dicirboxylic acid esters dissolve or swell resin contained in toner in a shorter time. For example, in high-speed printing at 60 ppm (page per minute), it is preferable that a time from when the fixing agent is applied to unfixed toner on a recording medium to when the toner is fixed onto the recording medium be one second or less. With the above-described aliphatic esters including aliphatic dicarboxylic acid esters, the time from when the fixing agent is applied to unfixed toner on a recording medium to when the toner is fixed onto the recording medium is 0.1 seconds or less. Further, the content of the softening agent in the fixing agent to dissolve or swell the resin contained in toner is reduced.

In the fixing agent according to the present invention, the above-described aliphatic dicarboxylic acid esters preferably include a compound expressed by a general formula: $R3(COOR4)_2$, where R3 is an alkylene group with a carbon number of 3 to 8 and R4 is a linear or a branched alkyl group with a carbon number of 3 to 5. When the carbon numbers of R3 and R4 are less than the desirable numbers, odors are generated. When the carbon numbers of R1 and R2 are more than the desirable numbers, the resin softening ability is reduced.

When the above-described aliphatic dicarboxylic acid esters include the above-described compound expressed by $R3(COOR4)_2$, the ability to dissolve or swell resin contained in toner is improved. Also, the above-described compound has an odor index of 10 or less and does not have unpleasant and irritating odors.

Aliphatic dicarboxylic acid esters included in the above-described compound are, for example, 2-ethylhexyl succinate, dibutyl adipate, diisobutyl adipate, diisopropyl adipate, diisodecyl adipate, diethyl sebacate, and dibutyl sebacate. Many of these aliphatic dicarboxylic acid esters dissolve in a lipid solvent but do not dissolve in water. Therefore, in an aqueous solvent, the fixing agent contains glycols as a dissolution auxiliary agent so that many of these aliphatic dicarboxylic acid esters are dissolved or in microemulsion form.

In the fixing agent according to the present invention, the above-described aliphatic esters preferably include dialkoxyalkyl aliphatic diarboxylates. The aliphatic esters including dialkoxyalkyl aliphatic diarboxylates improve fixing of toner onto a recording medium.

In the fixing agent according to the present invention, the dialkoxyalkyl aliphatic diarboxylates preferably include a compound expressed by a general formula: $R5(COOR6\text{-}O\text{—}R7)_2$, where R5 is an alkylene group with a carbon number of 2 to 8, R6 is an alkylene group with a carbon number of 2 to 4, and R7 is an alkyl group with a carbon number of 1 to 4. When the carbon numbers of R5, R6, and R7 are less than the desirable numbers, odors are generated. When the carbon numbers of R1 and R2 are more than the desirable numbers, the resin softening ability is reduced.

When the above-described dialkoxyalkyl aliphatic diarboxylates include the above-described compound expressed by $R5(COOR6\text{-}O\text{—}R7)_2$, the ability to dissolve or swell resin contained in toner is improved. Also, the above-described compound has an odor index of 10 or less and does not have unpleasant and irritating odors.

Dialkoxyalkyl aliphatic diarboxylates included in the above-described compound are, for example, diethoxyethyl succinate, dibutoxyethyl succinate, diethoxyethyl adipate, dibutoxyethyl adipate, and diethoxyethyl sebacate. In an aqueous solvent, the fixing agent contains glycols as a dissolution auxiliary agent so that these dialkoxyalkyl aliphatic diarboxylate are dissolved or in microemulsion form.

In addition to aliphatic esters, citric esters, ethylene carbonates, and propylene carbonates are suitable as the softening or swelling agent.

It is also preferable that the fixing agent contain a 1:1 type fatty acid alkanolamide to provide an excellent foam stability such that the foams in the foam-like fixing agent penetrate a particulate layer such as toner without being broken at the nip part while being pressed. When the foams are broken, the fixing agent is inhibited from penetrating the particulate layer. It should be noted that although there are two types, 1:1 type and 1:2 type of the fatty acid alkanolamide, 1:1 type fatty acid alkanolamide is suitable for the present invention.

It should be noted that resin-containing particulates for fixing is not limited to toner and may be any particulates containing resin. For example, the resin-containing particulates may include a conductive material. Also, the recording medium is not limited to a recording sheet of paper. The recording medium may be of metal, resin, or ceramic. However, it is preferable that the medium allow penetration of the fixing agent. As for the medium substrate that does not allow penetration of the fixing agent, a liquid penetration layer is preferably provided on the substrate. The form of the recording medium is not limited to a sheet, and may be a three-dimensional form with a planar or curved surface. For example, the present invention is applied to evenly fix transparent resin particulates on a medium such as a paper sheet to protect a surface of the paper (generally referred to as varnish coating).

Among the particulates containing resin, the toner used in an electrophotographic process is most effectively fixed in combination with the fixing agent according to the present invention. The toner contains a coloring agent, a charge control agent, and a resin such as a binder resin and a releasing agent. The resin contained in the toner is not particularly limited. Preferable binder resins include polystyrene resins, styrene-acryl copolymer resins, and polyester resins. Examples of the releasing agent include wax components such as carnauba wax and polyethylene. The toner may contain a known coloring agent, charge control agent, agent to providing flowability, and additives in addition to the binder resin. Also, it is preferable that the toner be water-repellent treated by fixing hydrophobic particulates, such as hydrophobic silica or hydrophobic titanium oxide, having a methyl group to the surface of the toner particulates. The recording medium is not particularly limited. For example, paper, cloth, or a plastic film such as an OHP sheet having a liquid penetration layer is used. The term "lipid" as used herein means that a solubility in water at room temperature of 20° C. is equal to or less than 0.1% by weight.

Also, it is preferable that the foam-like fixing agent have a sufficient affinity for water-repellent treated toner particulates. The affinity as used herein means that a degree of spreading of a liquid on the surface of a solid when the liquid contacts the solid. That is, it is preferable that the foam-like fixing agent exhibit a sufficient wetting ability to the water-repellent treated toner. The toner that is water-repellent treated with hydrophobic particulates, such as hydrophobic silica or hydrophobic titanium oxide, is covered with a methyl group present on the surface of the hydrophobic silica or hydrophobic titanium oxide and has a surface energy of approximately 20 mN/m. In practice, the entire surface of the water-repellent treated toner is not completely covered with the hydrophobic particulates and therefore the surface energy of the water-repellent treated toner is estimated to be approximately 20 to 30 mN/m. Therefore, it is preferable that the surface tension of the foam-like fixing agent be 20 to 30 mN/m to have an affinity for the water-repellent toner (sufficient wetting ability).

When an aqueous solvent is used, it is preferable to add a surfactant to have the surface tension of 20 to 30 mN/m. Also, with an aqueous solvent, it is preferable to contain a monohydric or polyhydric alcohol, which improves the foam stability of the foam-like fixing agent and prevents the foam from being broken. For example, monohydric alcohols such as cetanol or polyhydric alcohols such as glycerin, propylene glycol, and 1,3-butylene glycol are preferable. The monohydric or polyhydric alcohols are effective in preventing curing of the medium such as a paper sheet.

Also, it is preferable to form an O/W (oil-in-water) emulsion or W/O (water-in-oil) emulsion by containing a lipid component in the fixing agent to improve the penetrating ability and prevent curling of the medium such as a paper sheet. In this case, sorbitan fatty acid esters, such as sorbitan monooleate, sorbitan monostearate, and sorbitan sesquiolate, and sucrose esters, such as sucrose laurate ester and sucrose stearic acid ester, are preferable as a dispersing agent.

As for a method of dissolving the softening agent in the fixing agent or dispersing the softening agent in the fixing agent in microemulsion form, for example, the softening agent is mechanically agitated by a homomixer or a homogenizer using a rotating blade, or the softening agent is vibrated by a ultrasonic homogenizer. In any case, the softening agent is dissolved or dispersed in microemulsion form by applying a strong shear stress to the softening agent in the fixing agent.

The fixing device may include a pair of smoothing rollers (hard rollers) to apply a pressure to toner that is dissolved or swollen by an agent (softening agent) that at least partially dissolves or swells the resin contained in toner after the fixing agent according to the present invention is applied to the toner. The pair of smoothing rollers (hard rollers) applies a pressure to the dissolved or swollen toner, thereby smoothing the surface of the layer of the dissolved or swollen toner and providing gloss to the toner. Further, by pushing the dissolved or swollen toner into the recording medium, the fixing of the toner to the recording medium is improved.

An image of resin-containing toner is fixed onto a recording medium by using the above-described fixing method according to the present invention described above. Therefore, by using the fixing device according to the present invention, an image forming method and an image forming apparatus capable of fixing toner onto a recording medium more efficiently are provided.

Figure 19A:
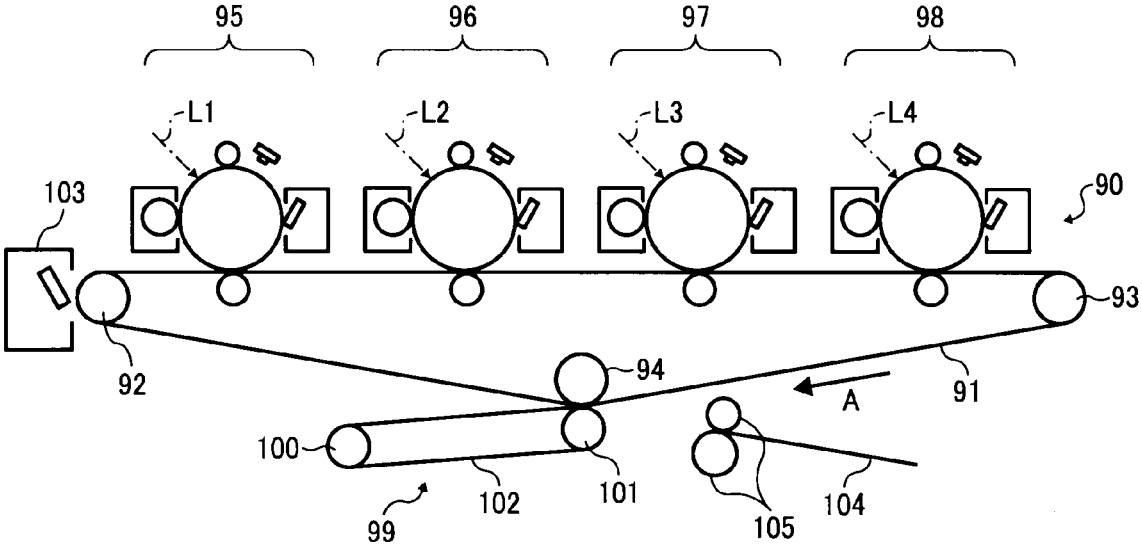
FIGS. 19A and 19B are schematic diagrams illustrating an example configuration of an image forming apparatus according to the present invention.
Figure 19B:
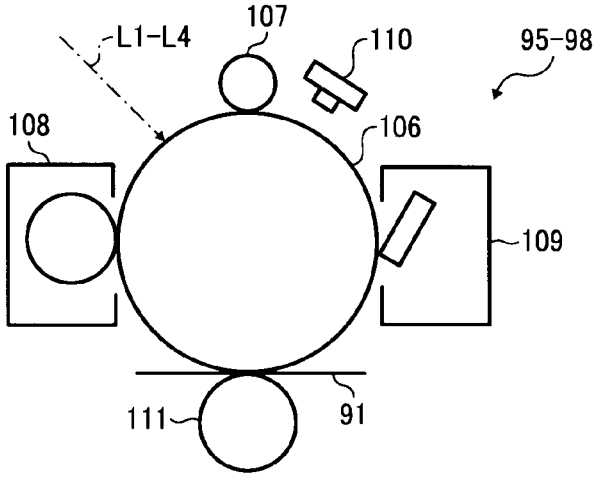

FIGS. 19A and 19B are schematic diagrams illustrating an example configuration of an image forming apparatus according to the present invention. The image forming apparatus can be a copier or a printer. FIG. 19A is a schematic diagram illustrating an overall configuration of a tandem color electrophotographic image forming apparatus and FIG. 19B is a schematic diagram illustrating a configuration of an image forming unit included in the image forming apparatus of FIG. 19A. The image forming apparatus 90 illustrated in FIG. 19A includes an intermediate transfer belt 91 as a toner image bearing member. The intermediate transfer belt 91 is stretched around three support rollers 92, 93, and 94 and rotates in the direction indicated by arrow A shown in FIG. 19A. Facing the intermediate transfer belt 91, image forming units 95, 96, 97, and 98 for black, yellow, magenta, and cyan, respectively, are disposed. An irradiation device, not shown, is disposed above the image forming units. For example, when the image forming apparatus 90 is a copier, a scanner reads image information of an original and the irradiation device irradiates photosensitive drums included in the image forming units with lights L1 to L4, respectively, based on the image information to write latent electrostatic images on each photosensitive drum. A secondary transfer device 99 is disposed opposite the support roller 94 with the intermediate transfer belt 91 therebetween. The secondary transfer device 99 includes a secondary transfer belt 102 stretched around two support rollers 100 and 101. A transfer roller may be used as the secondary transfer device 99 instead of using the transfer belt. A belt cleaning device 103 is disposed opposite the support roller 92 with the intermediate transfer belt 91 therebetween. The belt cleaning device 103 is provided to remove toner remaining on the intermediate transfer belt 91.

A sheet of recording paper 104 serving as a recording medium is sent to a secondary transfer part between the intermediate transfer belt 91 and the secondary transfer belt 102 by a pair of paper feed rollers 105. A toner image is transferred to the recording paper 104 by pressing the secondary transfer belt 102 against the intermediate transfer belt 91. The recording paper 104 with the toner image transferred thereto is conveyed by the secondary transfer belt 102 and the unfixed toner image on the recording paper 104 is fixed by the fixing device according to the present invention, which controls a thickness of the foam-like fixing agent based on the image information sent from the irradiation device, not shown. Specifically, the foam-like fixing agent with a thickness controlled based on image information of, for example, a color image or a solid black image sent from the irradiation device, not shown, is supplied from the fixing device according the present invention and applied to the unfixed toner image transferred to the recording paper 104. The unfixed toner image is fixed onto the recording paper 104 by using the agent (the softening agent) that is included in the foam-like fixing agent and at least partially dissolves or swells the resin contained in the toner.

The image forming units are now described.

As illustrated in FIG. 19B, in each of the image forming units 95 to 98, a charging device 107, a development device 108, a cleaning device 109, and a discharging device 110 are disposed around a photosensitive drum 106. A primary transfer device 111 is disposed opposite the photosensitive drum 106 with the intermediate transfer belt 91 therebetween. The charging device 107 is a charging device that employs a contact charging method and includes a charging roller. The charging roller contacts the photosensitive drum 106 to apply a voltage thereto, thereby uniformly charging the surface of the photosensitive drum 106. The charging device 107 may employ a non-contact charging method by using, for example, a non-contact scorotron. The development device 108 attaches toner in a developing agent to the latent electrostatic image formed on the photosensitive drum 106, thereby visualizing the latent electrostatic image. The toner of each color is formed of a resin material colored with each color and the resin material is dissolved or swollen by the fixing agent according to the present invention. The development device 108 includes an agitation unit, not shown, and a development unit, not shown, and the unused developing agent returns to the agitation unit to be reused. The toner density in the agitation unit is detected by a toner density sensor to maintain a constant toner density. The primary transfer device 111 transfers the toner image visualized on the photosensitive drum 106 to the intermediate transfer belt 91. The primary transfer device 111 uses a transfer roller and presses the transfer roller against the photosensitive drum 106 with the intermediate transfer belt 91 therebetween. As the primary transfer device 111, a conductive brush or a non-contact corona charger may be used. The cleaning device 109 removes unnecessary toner on the photosensitive drum 106. As the cleaning device 109, a blade with an end pressed against the photosensitive drum 106 is used. The toner removed by the cleaning device 109 is collected in the development device 108 and reused by a collection screw, not shown, and a toner recycling device, not shown. The discharging device 110 includes a lamp and initializes the surface potential of the photosensitive drum 106 by irradiating the photosensitive drum 106 with light.

Examples of the fixing agent and fixing according to the present invention are now described.

In the following examples according to the present invention, toner is used as the resin-containing particulates and prepared by the following example manufacturing method.

EXAMPLE 1

Formulation of Fixing Agent

Liquid Containing a Softening Agent

Dilution solvent: ion exchange water (53 wt %)

Softening agent: diethoxyethyl succinate (10 wt %, Crodamol DES manufactured by Croda Japan KK) and propylene carbonate (20 wt %)

Thickening agent: propylene glycol (10 wt %)

Foam increasing agent: 1:1 type coconut fatty acid diethanolamide (0.5 wt %, Marpon MM manufactured by Matsumoto Yushi-Seiyaku Co., Ltd.)

Foaming agent: amine palmitate (2.5 wt %), amine myristate (1.5 wt %), and amine stearate (0.5 wt %)

Dispersing agent: POE (20) sorbitan laurate (1 wt %, Rheodol TW-S120V manufactured by Kao Corporation) and polyethyleneglycol monostearate (1 wt %, Emanon 3199 manufactured by Kao Corporation)

The dispersing agent is used to promote solubility of the softening agent in the dilution solvent. The fatty acid amines are synthesized from fatty acid and triethanolamine.

After a solution is prepared by mixing and agitating the above-described ratio of components except the softening agent at a liquid temperature of 120° C., the softening agent is mixed with the solution to prepare a fixing agent (stock solution before foaming) in which the softening agent is dissolved by using a ultrasonic homogenizer.

Application Device

Large-Foam Generation Unit

The large-foam generation unit is made based on FIG. 15.

The above-described liquid fixing agent container: a bottle formed of PET resin

Agent conveyance pump: a tube pump (silicone rubber tube with an inner diameter of 2 mm)

Flow path: silicone rubber tube with an inner diameter of 2 mm

Microporous sheet to generate large foams: a #400 stainless mesh sheet (an opening diameter of approximately 40 μm)

Small-Foam Generation Unit The small-foam generation unit is made based on FIG. 15.

The inner cylinder of the double cylinders is fixed to a rotation shaft and rotated by using a rotation drive motor, not shown. The double cylinders are formed of PET resin. The outer cylinder has an inner diameter of 10 mm and a length of 120 mm and the inner cylinder has an outer diameter of 8 mm and a length of 100 mm. The number of rotations is variable over a range of 1,000 to 2,000 rpm.

Fixing Agent Application Unit

The fixing agent application unit is made based on FIG. 15. The fixing agent application unit includes the above-described small-foam generation unit that generates small foams to prepare and supply a foam-like fixing agent to an agent layer applicator blade. The gap between the agent layer applicator blade and the application roller is formed in two sizes: 25 μm and 40 μm.

Pressure roller: an aluminium alloy roller with a diameter of 10 mm is used as a core on which a polyurethane foam material ("Colorfoam (EMO)" (brand name) manufactured by Inoac Corporation) with an outer diameter of 50 mm is formed.

Application roller: a roller of stainless steel SUS coated with PFA resin for baking finish.

Agent layer applicator blade: a sheet of common plate glass with a thickness of 1 mm is attached to an aluminum alloy support plate. The glass surface faces the application roller so that the gap between the application roller and the glass surface is adjusted within the range of 10 to 100 μm.

The conveyance rate of paper sheets is 150 mm/s.

Result

In an electrophotographic printer (Ipsio Color CX8800 manufactured by Ricoh Company, Ltd.), when a sheet (Type 6200 manufactured by Ricoh Company, Ltd.) for use in a plain paper copier with a color image of unfixed toner formed thereon is inserted into the fixing device, the agent conveyance pump is driven so that the liquid fixing agent is pumped out of the fixing agent container and passes the flow path. When the fixing agent passes through the large-foam generation unit that generates large foams and the small-foam generation unit that makes the foams small, a foam-like fixing agent including small foams with a foam diameter of 5 to 30 μm is supplied from the agent supply opening to the application roller in one second. The bulk density of the foam-like fixing agent is approximately 0.05 g/cm$^3$.

An application test is conducted for each nip width of 1 mm (nip time of 6 ms), 15 mm (nip time of 100 ms), and 21 mm (nip time of 140 ms) by varying the distance between the shafts of the sponge pressure roller and the application roller. The thickness of the toner layer is 30 to 40 μm.

Figure 20:
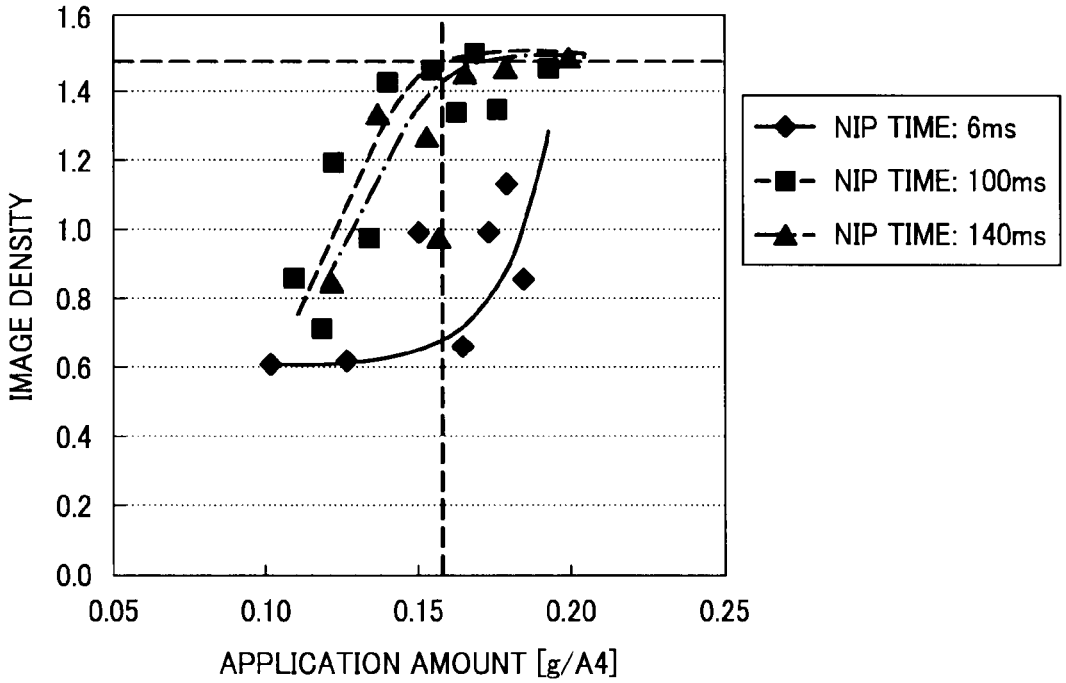
FIG. 20 is a graph illustrating application amount with respect to image density for each nip time in Example 1.

The penetration time of the above-described fixing agent is 80 to 100 ms. The result of the application test is shown in FIG. 20. The thickness of the foam-like fixing agent on the application roller is approximately 50 μm when the application amount of the fixing agent on the paper sheet is 0.15 g/A4. Also, the thickness of the foam-like fixing agent is approximately 35 μm for the application amount of 0.1 g/A4 and approximately 70 μm for the application amount of 0.2 g/A4. The reduction in the image density means that the toner is attached and offset to the application roller and the image is missed out on the paper sheet.

As can be seen from FIG. 20, when the nip time is equal to or more than the penetration time in an area in which the foam-like fixing agent layer thickness on the application roller is more than the toner layer thickness (the area with the application amount of the fixing agent of 0.15 g/A4 or more), the image is well fixed with a sufficient density so that the image is not missed out. By contrast, when the nip time is less than the penetration time even in the area in which the foam-like fixing agent layer thickness on the application roller is equal to more than the toner layer thickness, the toner is offset to the application roller, the image is missed out on the paper sheet, and the image density is significantly reduced.

In an area in which the foam-like fixing agent layer thickness on the application roller is less than the toner layer thickness (the area with the application amount of the fixing agent of 0.15 g/A4 or less), the toner is offset to the application roller, the image is missed out on the paper sheet, and the image density is significantly reduced even with the nip time of 100 ms. This is considered to be because the nip time is less than the penetration time since the penetration time is extremely long in the area in which the foam-like fixing agent layer thickness on the application roller is less than the toner layer thickness as illustrated in FIG. 12.

As described above, when the nip time is equal to or more than the penetration time, the image is well fixed by applying the foam-like fixing agent layer with a thickness more than that of the toner layer.

EXAMPLE 2

Figure 21:
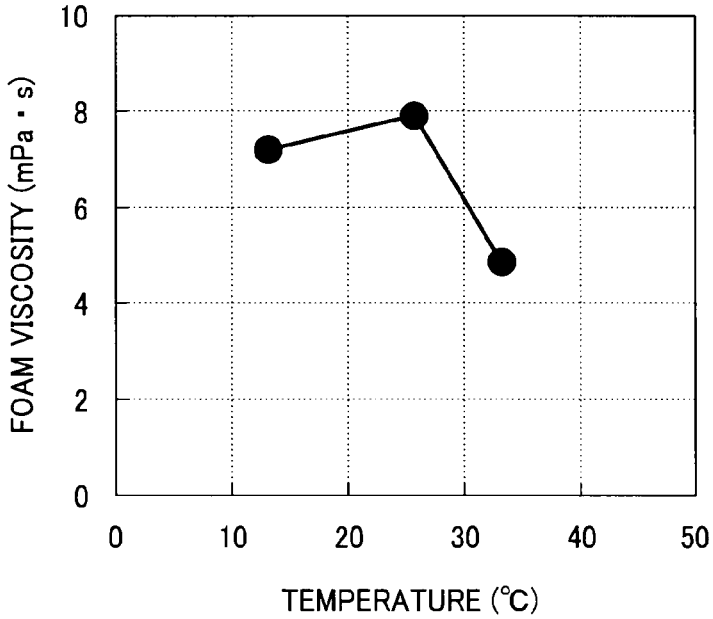
FIG. 21 is a graph illustrating temperature of a foam layer with respect to foam viscosity in Example 2.

The formulation of the fixing agent and the application device are the same as those used in Example 1. However, a fixing test is conducted at an environmental temperature, at which the device is used, of 15° C., 25° C., and 35° C. FIG. 21 illustrates the foam viscosity (the rotational viscosity measured by using a cone-plate rotational viscometer with a rotor diameter of 60 mm, a cone angle of 1 degree, and a gap between a plate and a cone of 3 mm, and the number of rotations per second is 10) of the foam-like fixing agent at each temperature. As can be seen from FIG. 21, the foam viscosity varies depending on the temperature (i.e., the foam viscosity decreases as the temperature increases). As can be seen from FIG. 14, the penetration time varies depending on the foam viscosity. Then, the nip time is set to be equal to or more than the penetration time by setting the data illustrated in FIG. 21 as table data, providing a temperature detection unit in the fixing device, and using a mechanism that changes the distance between the shafts of the application roller and the sponge pressure roller according to a temperature signal.

Result

In an electrophotographic printer (Ipsio Color CX8800 manufactured by Ricoh Company, Ltd.), the image is well fixed without being missed out for each environmental temperature of 15 to 35° C.

EXAMPLE 3

Formulation of Fixing Agent

Three fixing agents are prepared to ascertain the effect of 1:1 type fatty acid alkanolamide used in Example 1: A first formulation is the same as that of Example 1, a second formulation is the same as that of Example 1 except that the fatty acid alkanolamide is not contained, and a third formulation includes 1:2 type fatty acid alkanolamide (1:2 type coconut fatty acid diethanolamide (Marpon LS manufactured by Matsumoto Yushi-Seiyaku Co., Ltd.)) instead of the 1:1 type fatty acid alkanolamide in the same amount.

Result

In an electrophotographic printer (Ipsio Color CX8800 manufactured by Ricoh Company, Ltd.), a color image of unfixed toner is prepared and fixed using the same fixing device as used in Example 1.

As a result, as illustrated in Table 1, with the foam-like fixing agent including the 1:1 type fatty acid alkanolmaide, a uniform foam-like agent layer without pinholes is formed on the application roller and the image is well fixed. By contrast, with the fixing agent that does not contain fatty acid alkanolamide or the fixing agent containing the 1:2 type fatty acid alkanolamide, small pinholes (with a diameter of approximately 0.5 mm) are formed in the foam-like agent layer on the application roller, and numerous pinholes are generated in the fixed toner image. Therefore, the beneficial effect of the foam-like fixing agent containing the 1:1 type fatty acid alkanolamide is confirmed.

TABLE 1

| Density of Fatty acid amine (wt %) | Coconut fatty acid diethanolamide (wt %) | Foam viscosity (mPa · s) | Pinholes in the foam layer on the application roller |
|---|---|---|---|
| 4 | 0 | 3.70 | A few |
| 4 | (1:1 type) 0.5 | 5.15 | None |
| 4 | (1:2 type) 0.5 | 4.52 | A few |

As can be understood by those skilled in the art, numerous additional modifications and variations are possible in light of the above teachings. It is therefore to be understood that, within the scope of the appended claims, the disclosure of this patent specification may be practiced otherwise than as specifically described herein.

Further, elements and/or features of different example embodiments may be combined with each other and/or substituted for each other within the scope of this disclosure and appended claims.

Still further, any one of the above-described and other example features of the present invention may be embodied in the form of an apparatus, method, system, computer program or computer program product. For example, the aforementioned methods may be embodied in the form of a system or device, including, but not limited to, any of the structures for performing the methodology illustrated in the drawings.

Example embodiments being thus described, it will be apparent that the same may be varied in many ways. Such variations are not to be regarded as a departure from the spirit and scope of the present invention, and all such modifications as would be obvious to one skilled in the art are intended to be included within the scope of the following claims.

What is claimed is:

1. A fixing device comprising:

an application unit configured to apply a foam-like fixing agent having a predetermined layer thickness comprising a softener to particulates comprising a resin on a medium, the softener softening the particulates by at least partially dissolving or swelling the resin; and a control unit configured to control the application unit such that an application time during which the foam-like fixing agent is applied to the particulates is not shorter than a penetration time required for the foam-like fixing agent to penetrate through a layer of the particulates to the medium, wherein the control unit controls the application unit based on the penetration time varying depending on a foam viscosity.

2. The fixing device according to claim 1, wherein the control unit shortens the penetration time when the foam viscosity is reduced.

3. The fixing device according to claim 1, wherein the control unit controls the application unit based on the penetration time varying depending on a pressure applied to the particulates via the foam-like fixing agent.

4. The fixing device according to claim 1, further comprising a pressure control unit configured to control a pressure applied to the particulates via the foam-like fixing agent.

5. The fixing device according to claim 1, wherein the application unit comprises an application member having a roller form and a pressure member having a roller form disposed opposite the application member, at least one of the application member and the pressure member having a porous elastic layer.

6. The fixing device according to claim 1, wherein the application unit comprises an application member and a pressure member disposed opposite the application member, at least one of the application member and the pressure member having a belt form.

7. An image forming method comprising:

forming an unfixed toner image on a medium by an electrostatic recording process using a developing agent comprising particulates containing a resin and a coloring agent; and fixing the unfixed toner image onto the medium by applying a foam-like fixing agent to the unfixed toner image on the medium using the fixing device of claim 1.

8. An image forming apparatus comprising:

an image forming unit configured to form an unfixed toner image on a medium by an electrostatic recording process using a developing agent comprising particulates containing a resin and a coloring agent; and a fixing unit configured to fix the unfixed toner image onto the medium by applying a foam-like fixing agent to the unfixed toner image on the medium using the fixing device of claim 1.

* * * * *